US005921548A

United States Patent [19]

Goldberg

[11] Patent Number: 5,921,548

[45] **Date of Patent: *Jul. 13, 1999**

[54] GEOMETRIC AND CRYPTOGRAPHIC PUZZLE

[76] Inventor: Melvin L. Goldberg, 454 Third St. Apt. 2L, Brooklyn, N.Y. 11215

[ * ] Notice: This patent issued on a continued prosecution application filed under 37 CFR 1.53(d), and is subject to the twenty year patent term provisions of 35 U.S.C. 154(a)(2).

[21] Appl. No.: 08/780,986

[22] Filed: Jan. 9, 1997

[51] Int. Cl.[6] ..... A63F 9/00

[52] U.S. Cl. ..... 273/157 R; 273/156

[58] Field of Search ..... 273/153 R, 157 R, 273/156

[56] References Cited

U.S. PATENT DOCUMENTS

| | | | |
|---|---|---|---|
| 487,797 | 12/1892 | Thurston . | |
| 647,814 | 4/1900 | Dorr . | |
| 1,236,234 | 8/1917 | Troje | 273/157 R |
| 2,170,909 | 8/1939 | Moren | 273/157 R |
| 2,383,081 | 8/1945 | Ribbe | 273/157 R |
| 2,570,625 | 10/1951 | Zimmerman et al. | 273/157 R |
| 2,795,893 | 6/1957 | Vayo . | |
| 3,547,444 | 12/1970 | Williams | 273/157 R |
| 4,410,180 | 10/1983 | Clark | 273/156 |
| 4,715,605 | 12/1987 | Fritzman . | |
| 5,009,625 | 4/1991 | Longuet-Higgins . | |
| 5,338,043 | 8/1994 | Rehm | 273/153 R |
| 5,411,262 | 5/1995 | Smith . | |

*Primary Examiner*—Steven Wong

*Attorney, Agent, or Firm*—R. Neil Sudol; Henry D. Coleman

[57] ABSTRACT

Puzzles characterized by one or a number of sets of visually identical, physically interchangeable, rotatable pieces that either contain magnets with varying north/south orientations embedded in their sides and/or have a mark or markings on one or more of their edges and computer versions of these puzzles. The object of the puzzles is to arrange the pieces in predetermined shapes and sequences in such a manner that the sides of the pieces which are in contact with the sides of other pieces have opposite magnetic poles facing each other so that the pieces attract, rather than repel or, if edge markings are used with or instead of magnets, so that adjacent edge markings comply with specified rules. In addition, the pieces may be all visually identical except for differences in edge markings, if any, or, alternatively, there may be several sets of visually identical pieces, e.g., pink pieces, blue pieces, yellow pieces and orange pieces, which together comprise a puzzle set. Because each solution to the puzzle is a particular sequence of the puzzle pieces, that sequence of pieces can be used in various ways to generate cryptographic keys which will enable ciphertext, which accompanies the puzzle, to be decoded. In addition, with some methods of generating cryptographic keys from the sequence of pieces in the solution to the puzzle, partial cryptographic keys are generated before the puzzle is completely solved, enabling partial solutions of the puzzle to be checked to determine if they are correct, thereby simplifying very difficult puzzles and making possible the solution of otherwise virtually impossible puzzles.

54 Claims, 21 Drawing Sheets

| MAGNETS \ COLOR | P | B | Y | O |
|---|---|---|---|---|
| NNN | N N N | N N N | N N N | N N N 104 |
| NNS | N N S | N N S | N N S | N N S 106 |
| NSS | N S S | N S S | N S S | N S S 102 |
| SSS | S S S | S S S | S S S | S S S 102 |

| MAGNETS \ COLORS | P | B | Y | O |
|---|---|---|---|---|
| NNN | 0 | 1 12 | 0 | 1 15 |
| NNS | 2 1 11 | 3 9 10 14 | 2 3 13 | 1 2 104 |
| NSS | 2 6 7 | 0 | 2 5 16 | 2 4 8 102 |
| SSS | 0 | 0 | 0 | 0 |

| | | | | | | | | | | | | | | | |
|---|---|---|---|---|---|---|---|---|---|---|---|---|---|---|---|
| F | T | S | M | T | V | I | I | A | N | R | F | L | A | T | L |
| 6 | 20 | 19 | 13 | 20 | 22 | 9 | 9 | 1 | 14 | 18 | 6 | 12 | 1 | 20 | 12 |
| 6 | 11 | 1 | 7 | 14 | 9 | 10 | 12 | 13 | 5 | 16 | 3 | 2 | 4 | 15 | 2 |
| 12 | 31 | 20 | 20 | 34 | 31 | 19 | 21 | 14 | 19 | 34 | 9 | 14 | 5 | 35 | 14 |
| L | E | T | T | H | E | S | U | N | S | H | I | N | E | I | N |

112 113 110 115 114

| | | | | | | | | | | | | | | | |
|---|---|---|---|---|---|---|---|---|---|---|---|---|---|---|---|
| X | K | M | H | F | C | Y | R | P | I | L | T | M | L | V | R |
| 24 | 11 | 13 | 8 | 6 | 3 | 25 | 18 | 16 | 9 | 12 | 20 | 13 | 12 | 22 | 25 |
| 3 | 1 | 2 | 6 | 1 | 1 | 2 | 7 | 3 | 1 | 3 | 1 | 5 | 2 | 9 | 2 |
| 27 | 12 | 15 | 14 | 7 | 4 | 27 | 25 | 19 | 10 | 15 | 21 | 18 | 14 | 31 | 27 |
| A | L | O | N | G | D | A | Y | S | J | O | U | R | N | E | Y |

118 116 120

| | | | | | | | | | | | | | | | |
|---|---|---|---|---|---|---|---|---|---|---|---|---|---|---|---|
| W | F | B | I | M | D | V | I | K | Y | E | S | O | S | N | L |
| 23 | 6 | 2 | 9 | 13 | 4 | 22 | 9 | 11 | 25 | 5 | 19 | 15 | 19 | 14 | 12 |
| 12 | 6 | 10 | 11 | 14 | 7 | 9 | 4 | 16 | 15 | 3 | 8 | 5 | 1 | 13 | 2 |
| 35 | 12 | 12 | 20 | 27 | 11 | 31 | 13 | 27 | 40 | 8 | 27 | 20 | 20 | 27 | 14 |
| I | L | L | T | A | K | E | M | A | N | H | A | T | T | A | N |

122a 122c 122b 122d 122e

| | P | B | Y | O |
|---|---|---|---|---|
| NNN | 1 | 2 | 0 | 1 |
| NNS | 2 | 1 | 2 | 1 |
| NSS | 1 | 1 | 2 | 2 |
| SSS | 0 | 0 | 0 | 0 |
FIG. 7A
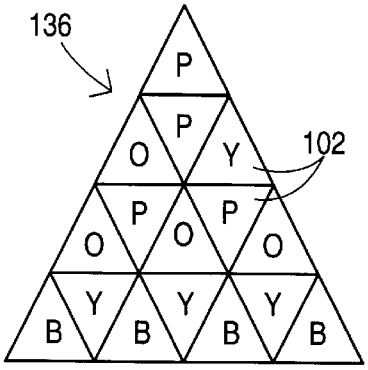
FIG. 7B
| | P | B | Y | O |
|---|---|---|---|---|
| NNN | 1 | 0 | 2 | 1 |
| NNS | 1 | 1 | 0 | 2 |
| NSS | 2 | 1 | 1 | 0 |
| SSS | 0 | 2 | 1 | 1 |
FIG. 8A
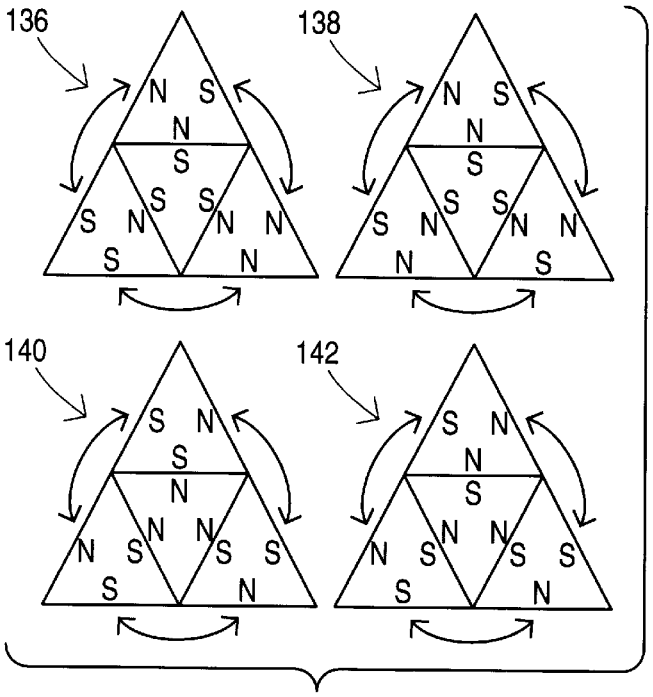
FIG. 8B
| | SSS | SSN | SNN | NNN |
|---|---|---|---|---|
| A | 1 | 1 | 1 | 1 |
| B | 1 | 0 | 3 | 0 |
| C | 0 | 3 | 0 | 1 |
| D | 0 | 2 | 2 | 0 |
FIG. 8C

| | | | | | | | | | | | | | | | | | | | | | | | | |
|---|---|---|---|---|---|---|---|---|---|---|---|---|---|---|---|---|---|---|---|---|---|---|---|---|
| 162 | T | S | J | P | Y | F | F | T | M | Y | R | Z | Y | F | I | C | I | L | Z | Q | I | X | L | A | Q |
| 164 | 20 | 19 | 10 | 16 | 25 | 6 | 6 | 20 | 13 | 25 | 18 | 26 | 25 | 6 | 9 | 3 | 9 | 12 | 26 | 17 | 9 | 24 | 12 | 1 | 17 |
| 160 | 25 | 15 | 21 | 3 | 6 | 6 | 6 | 25 | 6 | 6 | 9 | 19 | 9 | 25 | 3 | 9 | 10 | 16 | 25 | 3 | 25 | 7 | 7 | 4 | 10 |
| 166 | 45 | 34 | 31 | 19 | 31 | 12 | 12 | 45 | 19 | 31 | 27 | 45 | 34 | 31 | 12 | 12 | 19 | 28 | 51 | 20 | 34 | 31 | 19 | 5 | 27 |
| 168 | S | H | E | S | E | L | L | S | S | E | A | S | H | E | L | L | S | B | Y | T | H | E | S | E | A |

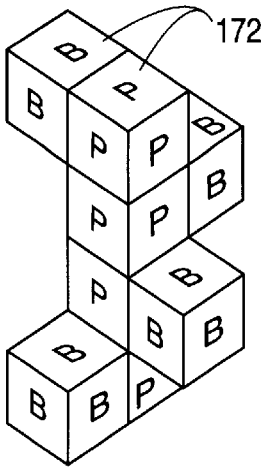
FIG. 17A
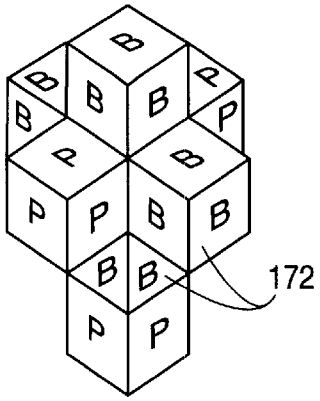
FIG. 17B
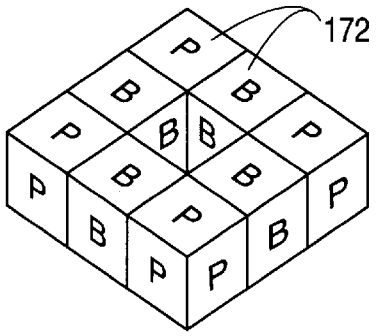
FIG. 17C
| | | | |
|---|---|---|---|
| P | Y | O | B |
| O | P | B | Y |
| Y | B | P | O |
| B | O | Y | P |
176
FIG. 18A
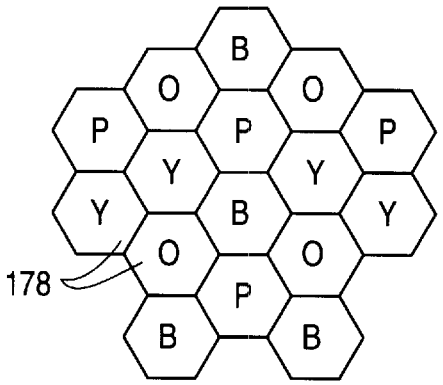
FIG. 18B

GEOMETRIC AND CRYPTOGRAPHIC PUZZLE

TECHNICAL FIELD

The present invention relates generally to games and puzzles and, more particularly, to games and puzzles in which a plurality of pieces are arranged to achieve a desired geometric pattern and/or shape. The present invention also relates to cryptographic games and puzzles in which decoding ciphertext is an object of the game or puzzle.

PRIOR ART

Prior art teaches a wide variety of spatial or visual puzzles, such as jigsaw puzzles, which are solved by properly arranging the pieces to achieve a desired result. The ancient "Chinese Puzzle" contains a number of oddly shaped pieces which can be combined in only one way to form a cube or ball or some other regular shape. Other examples of spatial puzzles include "Instant Insanity" and "Rubik's Cube".

Several games and puzzles of this type have been the subject of United States patents. For example, U.S. Pat. No. 4,257,609 issued to R. F. Squibbs, discloses a puzzle in which individual cubes are arrayed in a manner to provide a composite picture. Similar devices utilizing individual components to comprise a part of a greater visual whole are disclosed in U.S. Pat. No. 4,308,016 issued to P. A. White and U.S. Pat. No. 2,024,541 issued to E. F. Silkman. A domino related cube puzzle of S. N. Nelson is disclosed in U.S. Pat. No. 3,788,645, a colored cube puzzle of F. H. Kopfenstien is described in U.S. Pat. No. 4,189,151 and a rectangular parallelpiped is taught in U.S. Pat. No. 4,210,333, issued to S. R. Shanin.

The difficulty and challenge of a puzzle can be increased when various individual components have apparent interchangeability with some or all of the other components of the puzzle, since components then have to be actually assembled to test a theoretical solution. The ancient "Chinese Puzzles" do not have any apparent interchangeability since each of the pieces is different in shape. Furthermore, the apparent interchangeability of puzzles such as "Instant Insanity" is limited because there is a visual disparity between the components of various faces of the components. Any physical or visual disparity among the components limits the number of way in which the components can be logically assembled and thus decreases the degree of challenge to the person attempting to solve the puzzle because certain combinations can be eliminated mentally.

There are several examples of prior art puzzles which achieve physical component interchangeability but retain visual disparity. See U.S. Pat. No. 3,510,134 issued to H. A. Brooks, et al. and U.S. Pat. No. 4,258,479 issued to P. A. Roane. In some mosaic puzzles, such as Triazzles™, triangular pieces are not only interchangeable, but may also be rotated and used in the puzzle in one of three rotated positions, thereby making the solution of the puzzle challenging despite there being only 16 pieces. The pieces, however, are visually different, and each puzzle can be put together in only one way. Games and puzzles have also been taught in the prior art, such as polyominoes, where the pieces are all the same shape, such as triangles, squares or pentagons, but identifying marks vary, and must be arranged so that adjacent edges of each piece match. See U.S. Pat. Nos. 3,608,906, 3,687,455, 3,837,651, and 3,981,503 issued to M. Odier; U.S. Pat. No. 3,547,444 issued to R. K. Williams; U.S. Pat. Nos. 487,797 and 487,798 issued to E. L. Thurston; and U.S. Pat. No. 647,814 issued to D. Dorr. Because of the visual disparity of the pieces, these prior art puzzles and games, while somewhat difficult, generate limited interest for adults and older children who lose interest unless there is considerable challenge. Further, these prior art puzzles generally can be configured in only one or a small number of ways, and can generally not be used at different skill levels. Nor is there a cryptographic component in any of these prior art puzzles, as there is in the present invention, which enhances interest in solving the puzzle by adding a second level to the puzzle.

Several puzzles have also been taught which use interchangeable and visually identical pieces that contain internal properties which become apparent only when the pieces are put together, thereby making the solution of the puzzle more difficult. For example, in U.S. Pat. No. 4,491,326 D. P. Halsey, a puzzle is disclosed in which translucent pieces of plastic are visually identical but are differently optically polarized, requiring the user to arrange the pieces with respect to each other in a prescribed manner. In U.S. Pat No. 5,101,296, B. Bell teaches a similar method for making a bi-level jigsaw puzzle. In U.S. Pat. Nos. 4,886,273 and 5,127,562, V. Unger teaches various sets of three-dimensional components with reversible breakability which can be assembled into various objects, such as spheres, dumbbells or cubes, which can be thrown against a wall or other hard surface and then be put back together, in which the pieces are held together by magnets.

In addition, a number of building block sets using magnets have been taught. See U.S. Pat. No. 2,795,893 issued to H. E. Vayo; U.S. Pat. No. 5,009,625 issued to M. S. Longuet-Higgins; and U.S. Pat. No. 5,520,396 issued to J. M. Therrien. In U.S. Pat. No. 1,236,234, O. R. Troje teaches a set of building blocks each containing one or more magnets which can be put together in a variety of configurations. Finally, in U.S. Pat. No. 5,411,262 M. Smith teaches a set of puzzles in which two-dimensional pieces can be formed into three-dimensional hollow objects.

None of these prior arts, however, utilizes the full potential of using magnets embedded in puzzle pieces or, alternatively, pieces with edge markings and specified rules for adjacent pieces, to create puzzles and games which have interchangeable, rotatable and visually identical pieces each of which can be used in a wide variety of ways to appeal to a broad range of ages and skill levels of the users.

In addition, the prior art includes a number of patents where cryptography is used as an aspect of a puzzle or a game. See, for example, U.S. Pat. No. 5,505,456 issued to J. Schmidt; U.S. Pat. No. 5,297,800 issued to G. Delaney; U.S. Pat. Nos. 5,479,506 and 5,338,043 issued to P. H. Rehm; U.S. Pat. No. 4,560,164 issued to P. Darling; U.S. Pat. No. 4,509,758 issued to J. Cole; U.S. Pat. No. 3,942,800 issued to D. Holbrook; and U.S. Pat. No. 3,891,218 issued to C. Hilgartner.

OBJECTS OF THE INVENTION

A general object of the present invention is to provide a puzzle or game of the type having game pieces placed in contiguity with each other to form a predetermined geometrical design.

Another object of the present invention is to provide such a puzzle or game, wherein the puzzle pieces can be used in hundreds or thousands of different ways, with each way requiring a different solution, providing greater interests than puzzles which have only a single or a limited number of solutions.

A further object of the present invention is to provide a game or puzzle with two kinds of game or puzzle components each utilizable to solve the other. Specifically, it is an object of the invention to provide a game or puzzle having a geometric component and a cryptographic component. Thus, it is intended to provide a game or puzzle wherein the game pieces can be used to generate a different cryptographic key for each solution to the puzzle, which can then be used to decode ciphertext accompanying the puzzle set, thereby enhancing interest in solving the puzzle.

An additional object of the present invention is to provide such a puzzle or game which can be manufactured inexpensively.

Yet another object of the present invention is to provide such a game or puzzle which can be used in ways designed by the user of the puzzle to challenge the user him- or herself or other users.

A supplemental object of the present invention is to provide such a puzzle or game which is easily expandable to increase the difficulty and number of uses of the puzzle set.

These and other objects of the present invention will be apparent from the descriptions and illustrations herein.

SUMMARY OF THE INVENTION

The present invention provides a game or puzzle kit in which the solution of a geometric puzzle and the solution of an associated cryptographic puzzle are interrelated in that solving the geometric puzzle allows the cryptographic puzzle to be solved, or vice versa. In a combination geometric and cryptographic game or puzzle in accordance with the invention, partial solutions can be checked, for example, by determining that a partial cryptographic solution does not make sense and that an associated partial geometric solution must be modified. This checking potential enables otherwise inordinately difficult or virtually impossible games or puzzles to be solved.

A method for playing a puzzle type game in accordance with the present invention utilizes a plurality of game pieces each having a plurality of sides. The game pieces embody at least one rule according to which the game pieces may be disposed adjacent to one another. The rule specifies that each side of each game piece may be placed adjacent to only selected sides of other game pieces. The method also utilizes an encryption of a predetermined cryptographic message. In playing the game, a player places the game pieces adjacent to each other in a particular permutation (selected by the user) to generate a predetermined geometrical design (for example, shown in a booklet or illustrated on a computer screen). The predetermined geometrical design is producible by any of a plurality of permutations of the game pieces. The object of the game, of course, is to place properly selected pieces in a proper permutation to reproduce the predetermined geometrical design. Once the game pieces are placed in the particular selected permutation to generate the predetermined geometrical design, the player generates a series of integers from the particular selected permutation. To that end, the game pieces bear indicia from which the series of integers is generated. In a simple embodiment of this feature, the indicia are simply integers printed or inscribed on the game pieces. The generated integers are algebraically combined with respective numbers of the encryption to derive successive alphanumeric characters. In the event that the derived alphanumeric characters fail to render a sensible message, the selected permutation is not a solution of the puzzle or game. Accordingly, the selected permutation must be at least partially modified by removing one or more of the game pieces of the that particular permutation and regenerating the predetermined geometrical design by placing the game pieces adjacent to each other in another particular permutation.

In accordance with one embodiment of the present invention, each side of the game pieces has one of exactly two possible states and a game piece side having a first one of the two possible states is permissibly placed adjacent only to sides of the game pieces having a second one of the two possible states. This embodiment can be realized, for example, by providing each side of a game piece with a permanent magnet having magnetic field lines oriented substantially normally to the side's edge or surface. In that case, it will be possible to place sides with north magnetic poles adjacent only to those game piece sides with south magnetic poles. This result can also be achieved through symbols, for example, where each side is provided with one of two kinds of marks, the rule specifying that sides adjacent to one another must be differently marked. Accordingly, placing the game pieces adjacent to each other in the selected permutation to generate the predetermined geometrical design includes placing the game pieces so that sides of the game pieces having the first one of the two possible states are adjacent only sides of the game pieces having the second one of the two possible states.

Pursuant to another feature of the present invention, the game pieces are each provided with an auxiliary marking such as one of a plurality of different colors. The predetermined geometrical design then includes a predetermined arrangement of the auxiliary markings of the game pieces. For example, the geometric design can include a particular color pattern. The placing of the game pieces adjacent to each other in the selected permutation to generate the predetermined geometrical design then includes placing the game pieces so that the auxiliary markings of the game pieces are positioned in the predetermined arrangement.

In a particular embodiment of the present invention, the auxiliary marking is a mark defining an angle with respect to a geometrical center of the respective game piece. This mark may look like a hand of a watch, for instance, while the predetermined arrangement of the markings is a specified sequence of angles of the marks to indicate a sequence of hours on successive game pieces. The placing of the game pieces adjacent to each other in the selected permutation to generate the predetermined geometrical design then includes rotating the game pieces so that the angles of the marks on the game pieces have the predetermined arrangement.

The game pieces may be essentially planar pieces each having at least three sides, so that the placing of the game pieces adjacent to each other in the selected permutation to generate the predetermined geometrical design includes placing the sides of the game pieces in contiguity with one another. Alternatively, the game pieces may be three dimensional forms each having at least four planar sides or faces, so that the placing of the game pieces adjacent to each other in the selected permutation to generate the predetermined geometrical design includes placing the faces of the game pieces in contiguity with one another.

In accordance with another alternative, the game pieces are circular with sides defined by ancillary characteristics of the game pieces so that each game piece has only a limited number of permissible orientations with respect to any adjacent game piece. The placing of the game pieces adjacent to each other in the selected permutation to generate the predetermined geometrical design then includes placing the game pieces so that each of the game pieces has only permissible orientations with respect to all adjacent game pieces. The ancillary characteristics of the circular pieces which limit the possible orientations of the pieces relative to each other may take the form of magnetic field lines generated by a plurality of magnets in each of the game pieces. The placing the game pieces adjacent to each other in the selected permutation to generate the predetermined geometrical design accordingly would include placing the game pieces so that sides of the game pieces having a north magnetic field pole are adjacent only sides of the game pieces having a south magnetic field pole. The use of hour-hand-type auxiliary markings discussed above is especially advantageous in this watch- or clock-face implementation of the invention.

Generally, it is contemplated that a game or puzzle played in accordance with the present invention provides an order by which the game pieces placed in the predetermined geometrical design are to be inspected to determine the series of integers which is generated. Thus, the game or puzzle kit includes an indication of an order in which game pieces placed in any given permutation to produce the predetermined geometrical design are to be considered in generating the series of integers.

It is to be noted that a game or puzzle in accordance with the present invention may be implemented in an electronic game, either a hard wired game, or a game on a general purpose digital computer. Thus, the game pieces, the rule, the encryption, the cryptographic message, and the predetermined geometrical design may be all defined in a memory of a computer or microprocessor. In this case, the placing of the game pieces adjacent to each other in the selected permutation to generate the predetermined geometrical design includes entering instructions into the computer or microprocessor to position images of the game pieces on a display. Generating the series of integers from the selected permutation and the algebraic combining of the integers with respective numbers of the encryption to derive successive alphanumeric characters may be implemented automatically by operating the computer or microprocessor.

In accordance with another feature of the present invention, the indicia by which the integers are determined may include a first recognizable characteristic and a second recognizable characteristic of the game pieces. The recognizable characteristics may be merely identifications of different kinds of game pieces so that each piece of a certain kind have the same identification. The identifications may be symbols on the game pieces. The symbols indicate a first subset of game pieces all having the first recognizable characteristic and a second subset of game pieces all having the second recognizable characteristic distinguishable from the first recognizable characteristic. The generating of the series of integers then includes counting a number of the game pieces between successive occurrences of the first recognizable characteristic and a number of the game pieces between successive occurrences of the second recognizable characteristic.

A game kit comprises, in accordance with the present invention, a plurality of game pieces each having a plurality of sides, the game pieces embodying at least one rule according to which the game pieces may be disposed adjacent to one another, the rule specifying that each side of each game piece may be placed adjacent to only selected sides of other game pieces. The game kit further comprises a plurality of pictorial representations showing respective predetermined geometrical designs in which the game pieces may be placed, each of the predetermined geometrical designs being producible by any of a plurality of permutations of the game pieces. The game kit also includes encryptions of a plurality of predetermined cryptographic messages, each of the predetermined geometrical designs being associated with at least one of the predetermined cryptographic messages so that each combination of one of the predetermined geometrical designs and one of the predetermined cryptographic messages represents a respective puzzle solvable in part by (a) generating a series of integers from a selected permutation of the game pieces, the game pieces bearing indicia from which the series of integers is generated, and (b) algebraically combining the integers with respective numbers of a respective encryption to derive successive alphanumeric characters.

As discussed above with reference to the game or puzzle method of the present invention, each side of the game pieces in a kit according to the present invention may have one of exactly two possible states, wherein a game piece side having a one possible state is permissibly placed adjacent only sides of the game pieces having a second possible state. This rule is physically embodied each side of the game pieces is provided with a magnet having a magnetic field with field lines oriented substantially perpendicularly to the surface of the side.

As additionally discussed above, the game pieces may be essentially planar pieces each having at least three sides, solids each with at least four faces, or circular pieces with sides defined by ancillary characteristics of the game pieces so that each game piece has only a limited number of permissible orientations with respect to any adjacent game piece.

Again, the game pieces may be each provided with an auxiliary marking which is one of a plurality of possible markings (e.g., different colors or hour-hand type angle marks), a plurality of the game pieces having a first one of the possible markings and another plurality of the game pieces having a second one of the possible markings, the predetermined geometrical designs each including a predetermined arrangement of the auxiliary markings of the game pieces.

In a simplest or most straightforward exposition of the procedure for generating the integer series, the indicia are numerals provided on the game pieces. Alternatively, the indicia include a first recognizable characteristic and a second recognizable characteristic, while the game pieces include a first subset of game pieces all having the first recognizable characteristic and a second subset of game pieces all having the second recognizable characteristic distinguishable from the first recognizable characteristic. In that event, the series of integers is generated by counting a number of the game pieces between successive occurrences of the first recognizable characteristic and a number of the game pieces between successive occurrences of the second recognizable characteristic.

Pursuant to another feature of the invention, the game kit further comprises an indication of an order in which game pieces placed in any given permutation to produce the predetermined geometrical design are to be considered in generating the series of integers.

In one embodiment of the invention, the game pieces, the rule, the encryption, the cryptographic message, and the predetermined geometrical design are all defined in a memory of a computer or microprocessor, the computer or microprocessor having a display for displaying the game pieces, the predetermined geometrical designs, and the encryptions.

A game kit comprises, in accordance with a general conceptualization of the present invention, a plurality of game pieces each having a plurality of sides. The game pieces embody at least one rule according to which the game pieces may be disposed adjacent to one another. The rule specifies that each side of each game piece may be placed adjacent to only selected sides of other game pieces. In addition, at least some of the game pieces are each provided with an auxiliary marking which is one of a plurality of possible markings. Game pieces of a first plurality thereof have a first one of the possible markings, while games pieces of another plurality of the game pieces have a second one of the possible markings. The game kit further comprises a graphic representation of a predetermined geometrical design indicating a predetermined composite configuration of the game pieces and a predetermined arrangement of the auxiliary markings provided on the game pieces. The game is played by placing the game pieces adjacent to each other to generate the predetermined geometrical design.

Generally, the predetermined geometrical design is producible by any of a plurality of permutations of the game pieces. Preferably, although not necessarily, the game kit further comprises an ancillary puzzle keyed to the predetermined geometrical design and means on the games pieces for enabling a determination of clues to solving the ancillary puzzle after placement of the game pieces in the particular permutation. The ancillary puzzle may include an encryption of a predetermined cryptographic message and the clues may be integers. The integers for solving the ancillary puzzle are generated by inspecting indicia born by the game pieces. The ancillary puzzle is solved by algebraically combining the integers with respective numbers of an encryption to derive successive alphanumeric characters.

Variations of this general conceptualization of the invention, deducible from the summary description provided above, include variations in the kinds of game pieces, the rule regarding their contiguous placement, the auxiliary markings, the different kinds of predetermined geometrical designs available for each set of game pieces, the indicia for generating the encryption solving numerals A game kit comprises, in accordance with another general conceptualization of the present invention, a plurality of game pieces each having a plurality of sides, the game pieces each bearing indicia from which integers may be generated upon placement of the game pieces in a permutation or arrangement. The game kit provides an indication of an order in which game pieces placed in any given permutation or arrangement are to be considered in generating the series of integers. Also, the game kit includes an encryption of predetermined cryptographic message representing a puzzle solvable in part by (a) generating a series of integers from a selected permutation or arrangement of the game pieces, (b) algebraically combining the generated integers with respective numbers of a respective encryption to derive successive alphanumeric characters, and (c) determining whether the derived alphanumeric characters represent an apprehendable message.

Pursuant to this conceptualization of the invention, the game pieces may be realized by conventional or previously existing game pieces. The challenge derives in novel part to the cryptographic component added to a conventional geometric game or puzzle.

The inventor has been unable to find any prior art which combines, in a single puzzle apparatus, the solving of a puzzle on a first level, whose solution can be checked without reference to whether it deciphers ciphertext, with the solving of the puzzle on a second level, to decode ciphertext. Nor does the prior art teach any patents which utilize the sequence of puzzle pieces used to solve a puzzle to generate a cryptographic key which can then be used to decode ciphertext which accompanies the puzzle. This additional cryptographic component of the puzzle creates even greater interest in solving it, and, as explained below, permits otherwise nearly impossibly complex puzzles to be solved. Nor is there any prior art in which partial solutions of very difficult puzzles can be checked by determining whether that proposed partial solution is generating a correct partial cryptographic key, thereby signaling to users that progress in the solution to these difficult puzzle is being made to alleviate frustration.

This invention has many possible embodiments, as will become apparent in the description of the invention below. Each embodiment not only has the advantage of being able to be made very difficult to solve but can also be used in a variety of less difficult ways, thereby appealing to children and beginners, moving on to intermediate levels of difficulty which teenagers or adults would enjoy, and then reaching the most difficult level to challenge highly motivated and skilled adults. Moreover, the invention not only serves as a puzzle, but also is an educational tool, teaching logical, spatial, and mathematical thinking, as well as concepts of cryptography and, with respect to the puzzles utilizing magnets, magnetism.

BRIEF DESCRIPTION OF THE DRAWINGS

FIG. 7A is a table similar to FIGS. 2 and 3, showing another set of game or puzzle pieces.

FIG. 7B is a top plan view or graphic representation of the game or puzzle pieces of FIG. 7A arranged in a predetermined geometrical design, including a particular color sequence.

FIG. 8A is a table similar to FIGS. 2, 3 and 7A, showing an additional set of game or puzzle pieces.

FIG. 8B is a diagram of four pyramids, with sides folded down, constituting a single geometrical puzzle made from the triangular game pieces of FIG. 7A.

FIG. 8C is a table indicating four-piece subsets the game pieces of FIG. 8A utilizable to form pyramids.

FIGS. 17A–17C are isometric views of three different geometric configurations of the eight puzzle pieces of FIG. 16.

FIG. 18A is a top plan view or graphic representation of sixteen square game or puzzle pieces arranged in a square configuration with colors pink (P), blue (B), yellow (Y), and orange (O) as indicated.

FIG. 18B is a top plan view or graphic representation of sixteen hexagonal game or puzzle pieces arranged in a predetermined geometric configuration with colors pink (P), blue (B), yellow (Y), and orange (O) as indicated.

DESCRIPTION OF THE PREFERRED EMBODIMENTS

Some embodiments of the puzzle include one or more sets of visually identical and physically interchangeable puzzle pieces with shapes such as circles triangles, squares, pentagons, hexagons, or octagons, and which are either planar or curved to cover a sphere or other three-dimensional shape. Other embodiments of the puzzle comprise one or more sets of visually identical and physically interchangeable three dimensional shapes such as pyramids, cubes or dodecahedrons. Two embodiments of puzzle sets with planar pieces and one embodiment with three dimensional pieces will be described in detail below, and several other of the many possible embodiments will be briefly described.

Figures 1, 2, 3:
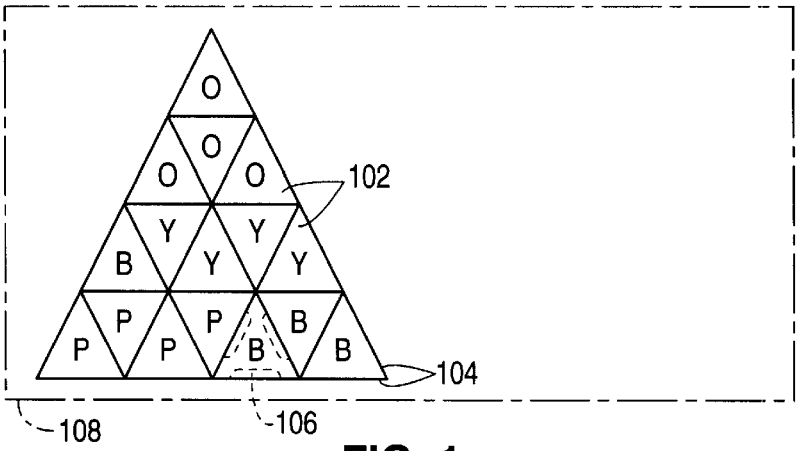
FIG. 1 is a top plan view or graphic representation of game or puzzle pieces arranged in a predetermined geometrical design.
FIG. 2 is a table showing the game or puzzle pieces of FIG. 1 and indicating magnetic fields along edges of the game pieces.
FIG. 3 is a table similar to FIG. 2, showing another set of game or puzzle pieces utilizable for reproducing the geometrical design f FIG. 1.

The first embodiment of the invention comprises 16 planar game pieces 102 each of which is an equilateral triangle, including four triangles of each of four colors, such as pink, blue, yellow, and orange, as indicated by the letter designations "P," "B," "Y," and "O" in FIGS. 1 and 2. Embedded in each edge 104 of each triangular puzzle piece 102 is a magnet 106 positioned so that the strongest magnetic field of each magnet is perpendicular to the respective triangle edge. The north/south orientation of each of the magnets with respect to the edge of the triangle is independent of the orientation of the other magnets within each piece, as indicated by the letters "N" and "S" in FIG. 2.

The object of the puzzle in this embodiment would be to arrange the 16 triangular pieces 102 in various predetermined geometrical designs or shapes and sequences identified in a booklet 108 (FIG. 1) accompanying the game or puzzle 102. One such geometrical design would be as a larger equilateral triangle with seven puzzle pieces 102 forming a base row, five puzzle pieces forming a next row up, three puzzle pieces forming a following row up, and one puzzle piece on the top, as illustrated in FIG. 1. One sequence to solve for this shape would be, starting in the base row in the lower left-hand corner of the large triangle and moving across, first all the pink (P) triangles, then all the blue (B) ones, then all the yellow (Y) ones, and finally all the orange (O) ones. See FIG. 1. Because of the varying internal orientations of the three magnets 106 in the edges 104 of each piece 102, the attraction and repulsion caused by the magnets in neighboring triangles make it necessary to have particular triangles in the proper sequence, rotated properly, in order for the pieces to all attract, rather than repel.

In this first embodiment of the invention there are four possible orientations of the three magnets 106 in each triangular piece 102, i.e. NNN, NNS, NSS, and SSS, as indicated in FIG. 2. Because game or puzzle pieces 102 are equilateral triangles, NNS is equivalent to NSN or SNN by simply rotating the piece. For each of the four orientations, any piece can be one of the four colors. Thus, in this embodiment there are 16 unique triangular game pieces 102 which could be utilized in making the puzzle. The 16 triangles actually utilized for a puzzle set, however, need not be one of each of the 16 possible triangles. Instead, there could be multiples of some pieces, e.g. two pink NSS pieces, and no pieces for some of the possible triangles, e.g. no blue SSS pieces. FIG. 3 shows a puzzle set which uses only 9 of the possible 16 triangles and 6 of the 16 pieces shown in FIG. 2 are used more than once. The fact that each piece can be rotated into three positions makes the solution of the puzzle considerably more challenging. As a triangular game piece 102 is rotated, the north/south orientations of the magnets 106 change in the bottom, left and right positions of the triangle. Each piece could be made with no external indication of the internal orientation of the magnets in the piece, requiring the user to either test each piece each time it is used to determine which edges are "norths" and which are "souths" or to label the edges in some manner. Alternatively, the pieces could be manufactured already labeled as to the magnetic orientations of the internal magnets. Even so labeled, the puzzles still require significant thought and effort to solve.

Figures 4A, 4B, 5A:
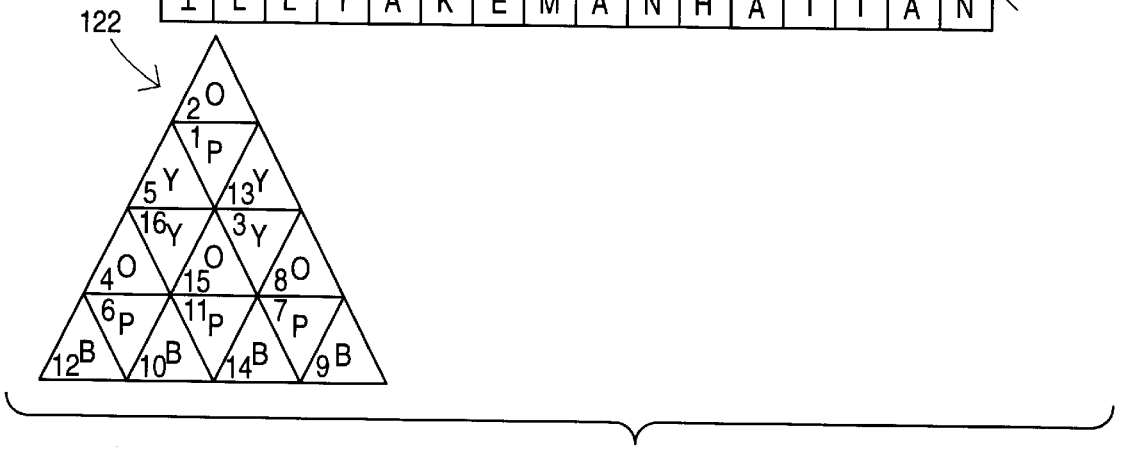
FIG. 4A is a table showing (i) a ciphertext or encryption, (ii) a sequence of integers derived from a particular permutation of the game pieces of FIG. 3 producing the geometrical design of FIG. 1, and (iii) a cryptographic message encoded by the ciphertext or encryption.
FIG. 4B is a table similar to FIG. 4A, showing another cryptographic message with an associated ciphertext or encryption, and a series of integers used with the ciphertext to solve the cryptogram, the integers being generated from a permutation of the game pieces of FIG. 3 producing the geometrical design of FIG. 1.
FIG. 5A is (a) a top plan view or graphic representation of another geometrical design utilizing the game or puzzle pieces of FIG. 2 or 3 and (b) a table showing an associated ciphertext, cryptographic message and a series of integers which is a cryptographic key to solving the cryptographic puzzle represented by the ciphertext.

The solution for each puzzle shape and sequence of colors can be used to generate a string of numbers or integers 110 (FIG. 4A) which can then be used as a cryptographic key of the Vigenere variety (see Scientific American, October 1989) to decode a ciphertext message or encryption 112 for that puzzle shape and color sequence. The ciphertext or encryption 112 is of a alphanumeric cryptographic message 114 and is set forth in booklet 108, together with a graphic representation of the associated geometrical design or arrangement of puzzle pieces 102. One of the many possible methods of generating a cryptographic key 110 from a solution to the geometric puzzle (FIG. 1) is to generate a string of 16 numbers by reading a unique number between 1 and 16 printed on each puzzle piece 102, starting at the lower left-hand corner of the large triangle solution (FIG. 1) and reading across, and then repeating this for each row of pieces above the base row. This preferred order of reading may be indicated in booklet 108. (A more difficult game would not provide a hint as to the proper integer reading order.) Using the puzzle shape and color sequence in FIG. 1 and puzzle pieces shown in FIG. 3, such a cryptographic key is illustrated in FIG. 4A for a solution of the FIG. 1 puzzle. FIG. 4A also shows a row of numbers 113 corresponding to the letters of the ciphertext or encryption 112 and a row of numbers 115 corresponding to the letters of the cryptographic message 114. Generally, in booklet 108, the only the ciphertext or encryption 112 is provided, the other rows being blank for filling in by the game player.

Another method of generating a cryptographic key from the solution to the puzzle is by counting the number of pieces 102 between identically marked pieces or pieces with identical orientations of magnets in their sides, regardless of their color. FIG. 4B illustrates this method of generating a cryptographic key for the puzzle shape and color sequence in FIG. 1 and puzzle set of pieces shown in FIG. 3. Once the string of 16 numbers or integers 116 which constitute the cryptographic key is generated, a ciphertext or encryption 118 is decoded by adding the cryptographic key to the numerical value (A=1, B=2, . . . Z=26) of the letters in the ciphertext. The resulting string of numbers are the numerical values of the plaintext cryptographic message 120, as indicated in FIGS. 4A and 4B. If the string of 16 numbers is generated by reading the unique numbers off of each puzzle piece, the partial solutions to the puzzle can be checked for correctness by seeing if the partial cryptographic key that partial sequence generates produces recognizable words or parts of words. If the string is generated by counting between repeating pieces, it is more difficult to use partial solutions because there are more possible repeating pieces (8 NNS's in this example) than there are differently numbered pieces of the same color. The puzzle book 108 accompanying a given set of puzzle pieces 102 could include puzzles to solve using either method of generating the cryptographic key, as well as other methods, thereby providing the user of the puzzle not only with a wide variety of levels of difficulty of puzzles to be solved, but also a variety of ways in which the puzzles must be solved as well.

Figure 5B:
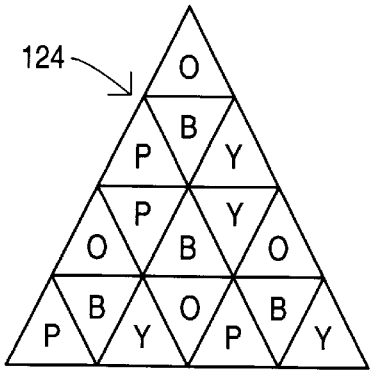
FIGS. 5B and 5C are top plan views or graphic representations of further geometrical designs utilizing the game or puzzle pieces of FIG. 2 or 3.
Figure 5C:
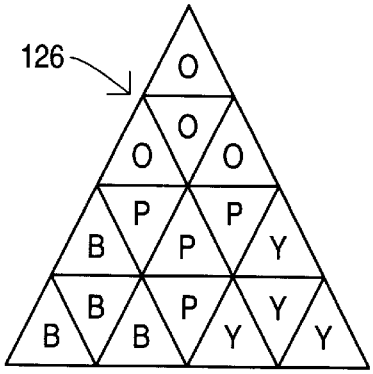
Figure 6A:
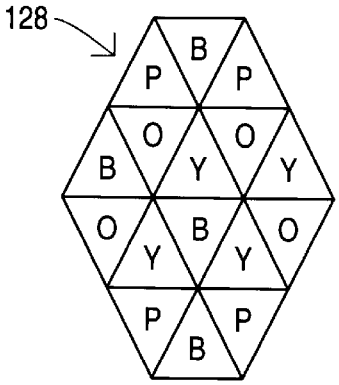
FIGS. 6A–6D are top plan views or graphic representation of four other geometrical design each utilizing the game or puzzle pieces of FIG. 2 or 3.
Figure 6B:
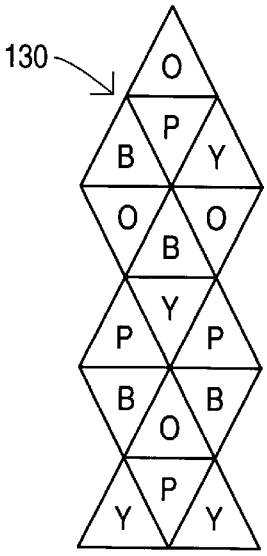
Figure 6C:
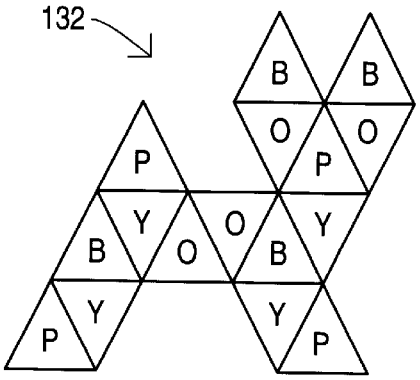
Figure 6D:
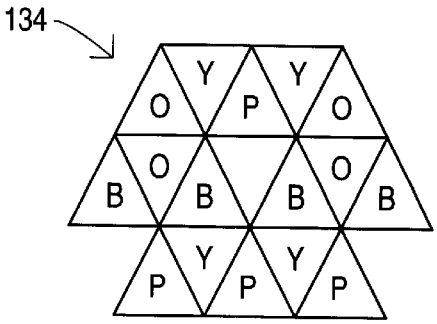

The 16 pieces 102 of the puzzle set of this preferred embodiment are used to form hundreds of different puzzles (geometrical designs) of widely varying levels of difficulty. For example, besides the color sequence described above for the large triangle (FIG. 1), there are thousands of other sequences of the four colors. For example, the sequence Pink, Blue, Yellow, Orange could be repeated four times. The four triangles of each color could be put together to make four small triangles, and those four small triangles can then be put together to form a large triangle. These and other interesting color sequences or geometrical designs 122, 124, and 126 are shown in FIGS. 5A, 5B, and 5C. For each of these color sequences, there would be a different ciphertext or encryption to solve with the cryptographic key (series of integers) generated from that solution of the puzzle. FIG. 5A shows such a ciphertext or encryption 122*a*, with a series of integers 122*b* constituting a cryptographic key for algebraic combination with numerical values 122*c* of the ciphertext to produce numerical values 122*d* of an alphanumeric cryptographic message 122*e*. In addition, for a given set of puzzle pieces, for some color sequences there may be more than one solution. When that occurs, a solution of the puzzle which allows the triangle pieces to be put in the desired color sequence would not necessarily generate the cryptographic key that would decode the accompanying ciphertext for that color sequence. Thus, while the puzzle would have been solved on one level, i.e. the pieces have been put together in such a way that the proper color sequence has been duplicated, it has not been solved such that the ciphertext can be decoded. Thus, further solutions to the color sequence must be found in order to decode the cipher text. For example, because of the six identically colored pieces with identical magnetic orientations in the puzzle set shown in FIG. 3, the solution of FIG. 1 in FIG. 4A is only one of 96 (2×2×2×2×2×3) possible solutions to the puzzle shape and color sequence. Only one of those sequences, however, generates the proper cryptographic key that will decode the ciphertext shown in FIG. 4A. Alternatively, for sequences where more than one solution to the puzzle is possible, a separate ciphertext can be provided for one or more of the other solutions.

Further, the puzzle pieces 102 can be used to make a multiplicity of different shapes, each with numerous different color sequences, either using all 16 pieces, or some lesser number. FIGS. 6A–6D show respective geometrical designs 128, 130, 132, and 134 using some or all of the pieces. In this way, there could be literally thousands of possible puzzles with a distinct cryptographic key and ciphertext message for each one which can only be decoded when each puzzle is solved. These different shapes and sequences are of widely varying levels of difficulty, which can be formed using the 16 pieces in the puzzle.

Depending on the particular set of puzzle pieces used to comprise a particular puzzle, some shapes and color sequences can be extraordinarily difficult to construct. For example, if a puzzle set comprises game pieces as listed in FIG. 7A and a large equilateral triangle 136 with the geometrical to be constructed is as shown in FIG. 7B, there are only a very small number of solutions to the puzzle. This is so because there are only 18 S's, all of which must be contiguous to one of the 30 N's. Thus, with this puzzle set, to make the large equilateral triangle figures with any color sequence, no edges with S orientation can face outward from the large equilateral triangle because there would then be an insufficient number of S's to match with 18 N's needed to form the large equilateral triangle. Puzzle sets can be made that can make the large equilateral triangle with any number of S edges ranging from 18 to 30, with those at the extremes being the most difficult to solve, and puzzles with 24 S's being the easiest to solve. The difficulty of solving the puzzles when the puzzle sets contain an extremely high or low number of S edged pieces can, however, be reduced by using portions of the cryptographic key generated as possible solutions to the color sequence. If the partial key produces text from the ciphertext which is clearly not words or parts of words, then that partial solution to the color sequence may then be rejected. In this manner, the cryptographic component of these puzzles not only increases the interest in solving the color sequence in order to decode the message, but it also can be used to simplify puzzles which could otherwise be inordinately difficult to solve.

Puzzle pieces 102 in this first embodiment could also be used to make three-dimensional shapes, such as pyramids each consisting of four equilateral triangular faces formed by pieces 102. Since there are 16 pieces, as enumerated in the table of FIG. 8A, four such pyramids 138, 140, 142, and 144 (FIG. 8B) can be made from the set. With the set of triangular game pieces tabulated in FIG. 8A, to make four pyramids from the set of 16 pieces would require using one of each type of piece, i.e., one SSS, one SSN, one SNN, and one NNN, in each pyramid (Type A pyramid, FIG. 8C). There are three other ways to make a single pyramid, as shown in FIG. 8C, i.e. one SSS and three SNN (Type B pyramid); one NNN and three NSS (Type C pyramid); and two SSN and two SNN (Type D pyramid). With the set of puzzle pieces shown in FIG. 8A, once one of the B, C or D pyramids is constructed there would not be enough of the remaining pieces of each kind to make three other pyramids in this particular embodiment of the puzzle. See FIG. 8B. Thus for this embodiment, the 16 pieces must be made into four Type A pyramids 138, 140, 142, and 144 and the pieces must separated into four subsets of four in a particular way, i.e., one of each of the four types of pieces in each pyramid. On the other hand, since there are for each type of puzzle piece three different colors in this embodiment, there are many different color combinations for the four pyramids. Ciphertext could be provided for the pyramid part of the puzzle which, in order to decode, would require not only four pyramids to be made but the "correct" four pyramids of the many possible combinations of colors.

Finally, there are numerous games which can be played using any particular set of triangular game pieces 102. For example, the set could be used to play a domino-type game in which the player who is the last able to play a piece in putting together one of the color sequences is the winner.

The puzzle in this first embodiment would include 16 game pieces 102, as well as booklet 108 containing dozens of illustrations of shapes and sequences of colors (geometric designs) along with ciphertexts or encryptions of cryptographic messages for each shape/color sequence combination, to be decoded once the cryptographic keys are generated. Books of additional puzzles to solve with illustrations of hundreds of other shape/color sequence combinations and ciphertext for each such combination could also be produced. Additional puzzle pieces and booklets could also be made to increase the original 16 piece set to, for example, 25 or 36 pieces, permitting significantly increased difficulty.

This embodiment could also be manufactured without any internal magnets 106, but with markings, such as "S" and "N" on each edge of each piece. One possible rule of arrangement would then simply be that each edge adjacent to another edge had to have the opposite symbol on the adjacent edge, i.e., S matched with N, not N with N or S with S. Such a puzzle set is easier and cheaper to manufacture but lacks the tactile feel and dynamics of the magnetic version with pieces that seem to jump into place when they are properly matched and push away from each other when they are not. Many other possible rules could also be employed with two or more possible markings on each side. On the other hand, the non-magnetic version can require greater concentration since the matching of the edges is by a rule that must be thoughtfully applied, rather than being the result of magnetic forces.

Figures 9A, 9B:
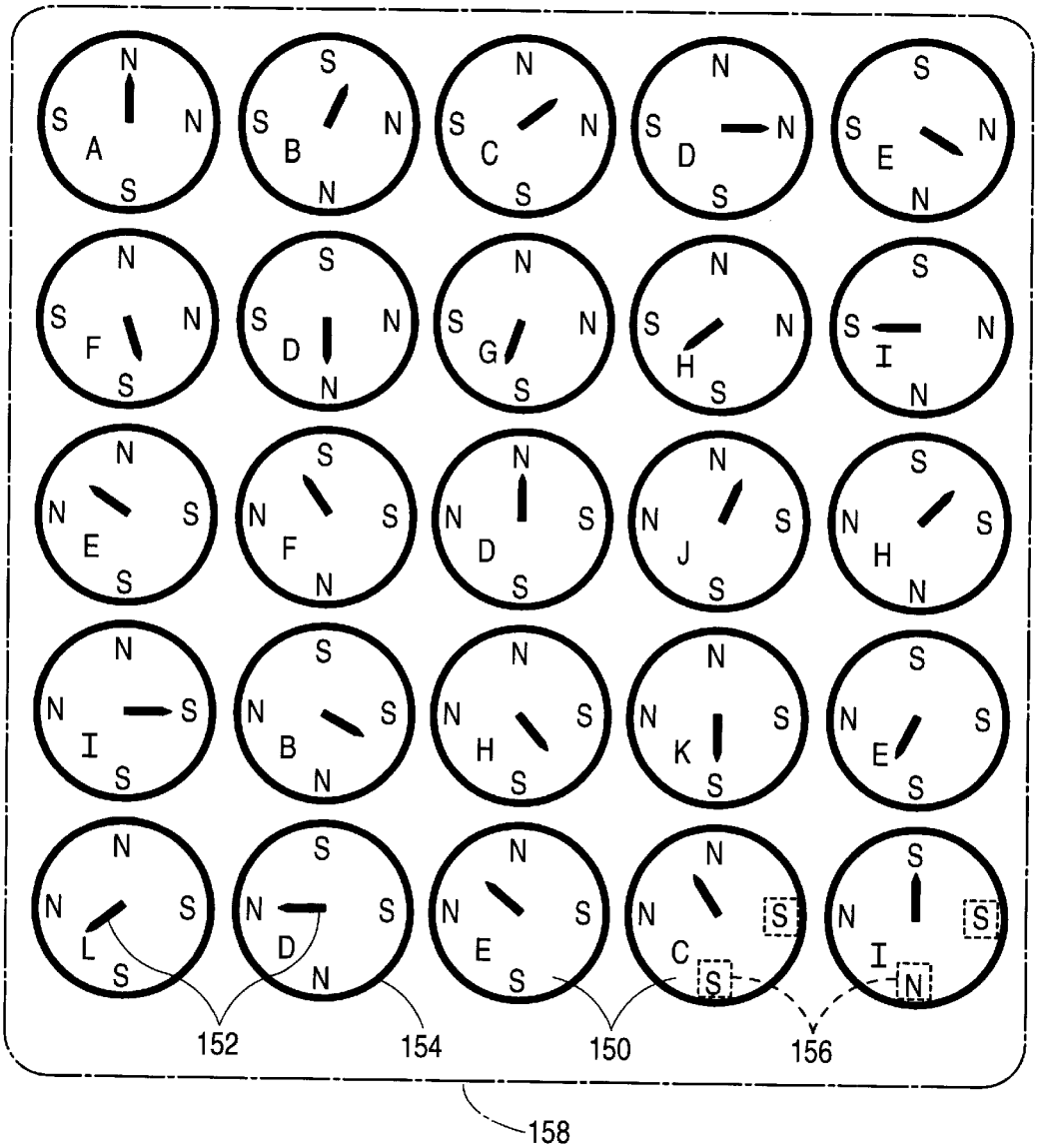
FIG. 9A is a top plan view or graphic representation of game or puzzle pieces arranged in a predetermined geometrical design.
FIG. 9B is a table showing (i) a ciphertext or encryption, (ii) a sequence of integers derived from a particular permutation of selected game pieces of FIG. 10 producing the geometrical design of FIG. 9A, and (iii) a cryptographic message encoded by the ciphertext or encryption.

A second embodiment of a game or puzzle with a geometric component and a cryptographic component is depicted in various forms in FIGS. 9A through 13C. FIG. 9A shows a particular geometric realization in which 25 identical circular disc pieces 150 are to be arranged in a 5×5 square array. Each disc 150 would be blank on the top except for a single arrow or hour hand 152 originating at the center of the respective disc and extending to an outer edge 154 of the disc. Thus, each disc 150 represents a clock face, with an hour hand pointing in one of twelve angles. Twelve identical hour markings (not shown) can be provided on discs 150. Encased within each of the discs 150 are four magnets 156 at the edges 154, set 90° apart, positioned so that the strongest magnetic field of each magnet is perpendicular to the edge of the disc. The north/south orientation of each of the magnets 156 with respect to the edge 154 of the respective disc 150 is independent of the orientation of the other magnets within each disc. In addition, the arrow or hour hand 152 on each disc 150 is at an angular rotation of 0°, 30°, or 60° with respect to the position on the edge of the disc of one of the four magnets 150. In this embodiment of the geometric/cryptographic game or puzzle, each of the discs 150 would represent a clock face in the 5×5 array of the 25 discs.

The object of the puzzle in this embodiment would be to arrange the 25 puzzle discs 150 in various predetermined orders or geometrical design in a tray 158 accompanying the puzzle in which the discs can freely rotate. One such order would be, starting in an upper left hand corner and moving across the array as if reading a book, 12 o'clock through each hour of the day and night and finishing back at 12 o'clock at the lower right hand corner of the array, as depicted in FIG. 9. Because of the varying internal orientations of the four magnets 156 in each side (as defined by the locations of the magnets), and the varying orientations of the arrows or hour hands with respect to the magnets, the attraction and repulsion caused by the magnets in neighboring discs make it necessary to have particular discs in the unique sequence, rotated the proper amount, in order for the clocks to advance one hour at a time. Otherwise, the discs will rotate or buckle and the arrows or hour hands 152 will not properly point to the desired position.

Figure 10:
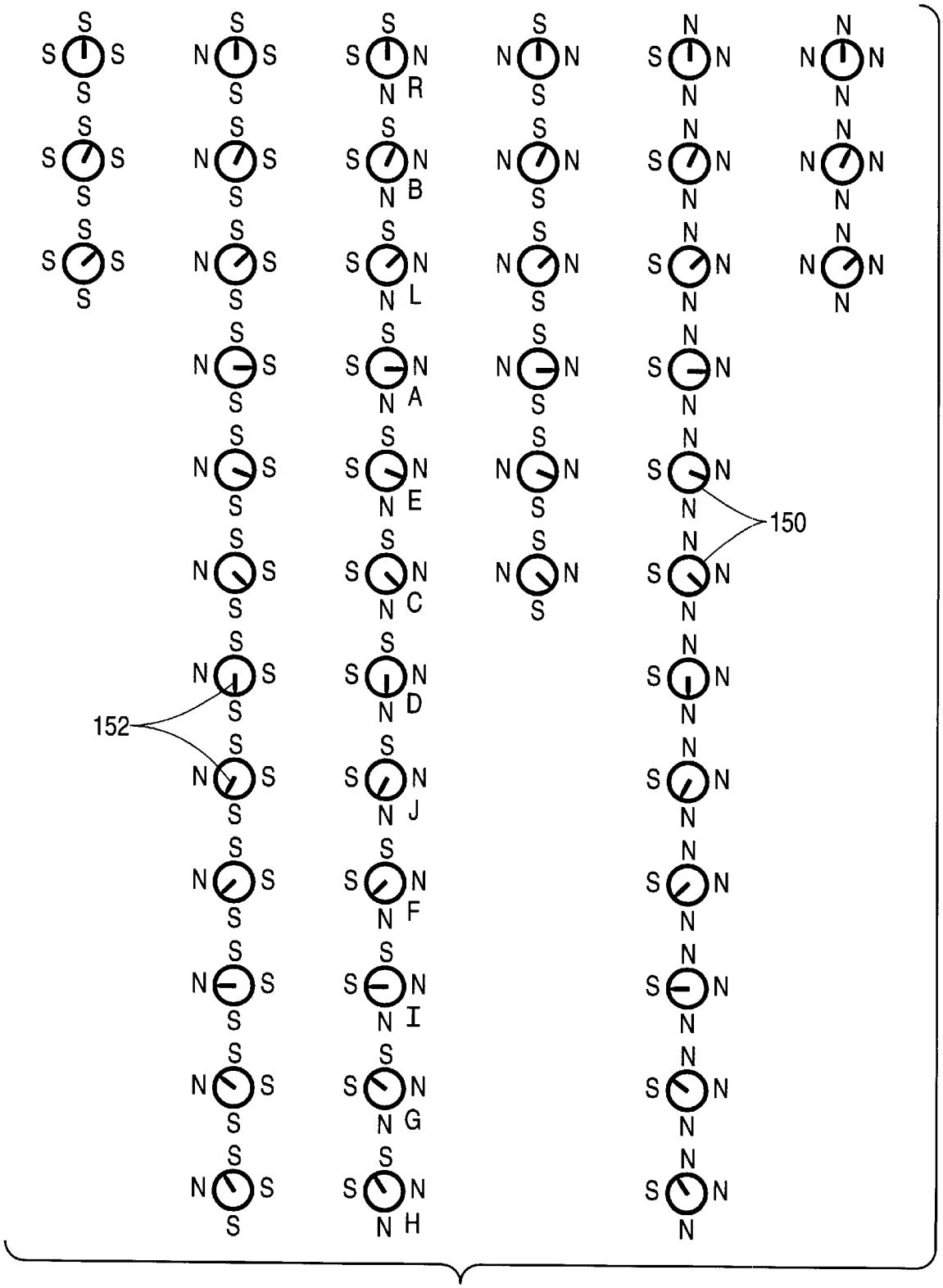
FIG. 10 is table showing all game or puzzle pieces of the type illustrated in FIG. 9A and indicating magnetic fields along edges of the game pieces.
Figure 11A:
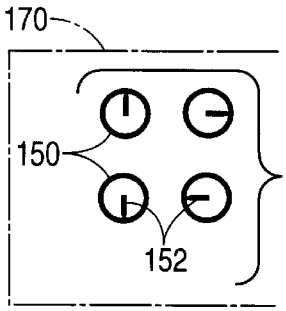
FIGS. 11A–11E are top plan views or graphic representations of game or puzzle pieces selected from those of FIG. 10, arranged in respective predetermined geometrical designs.
Figure 11B:
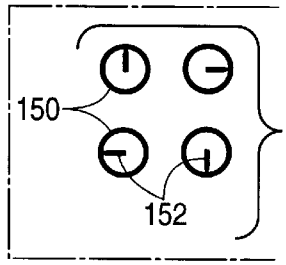
Figure 11C:
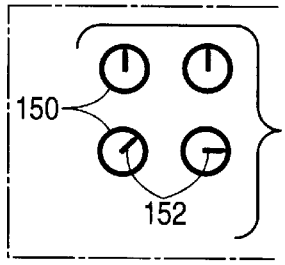
Figure 11D:
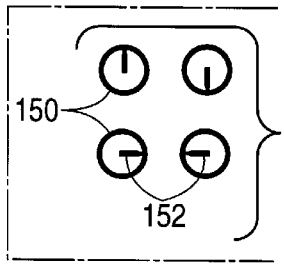
Figure 11E:
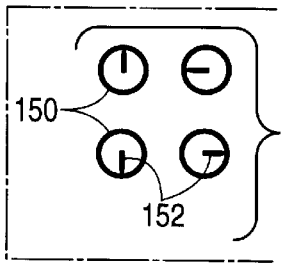
Figure 12A:
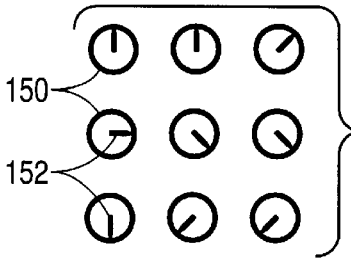
FIGS. 12A–12D are likewise top plan views or graphic representations of game or puzzle pieces selected from those of FIG. 10, arranged in respective predetermined geometrical designs.
Figure 12B:
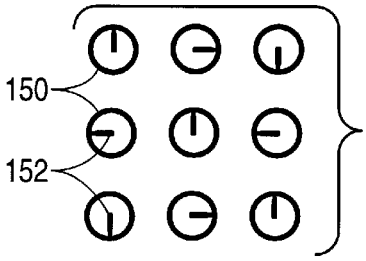
Figure 12C:
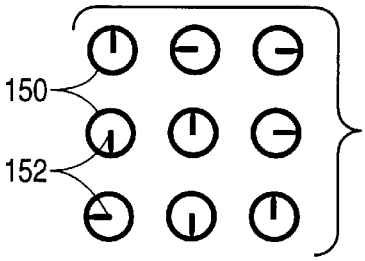
Figure 12D:
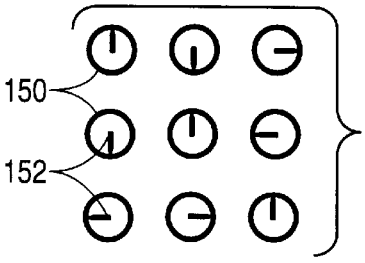
Figure 13A:
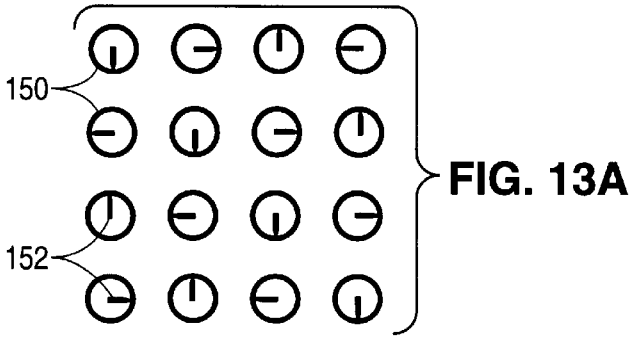
FIGS. 13A–13C are also top plan views or graphic representations of game or puzzle pieces selected from those of FIG. 10, arranged in respective predetermined geometrical designs.
Figure 13C:
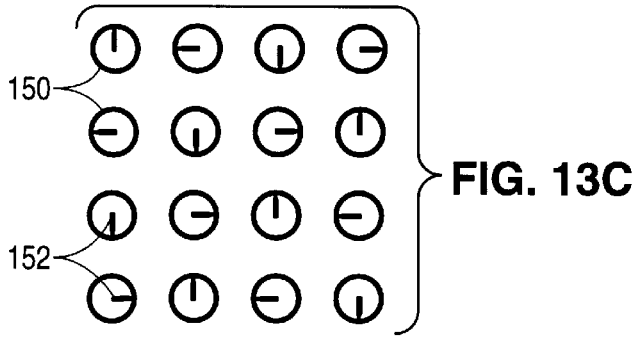
Figure 13B:
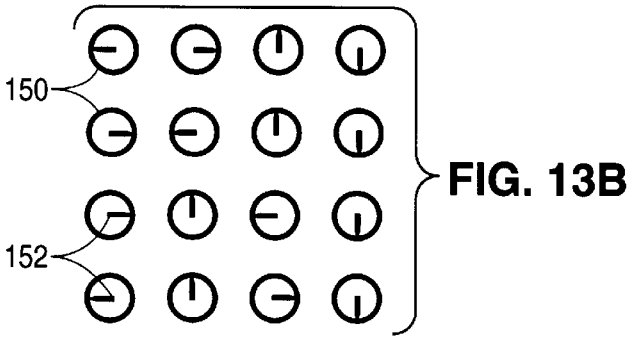

In this embodiment of the invention there are 48 possible unique discs which could be utilized in making the puzzle, as illustrated in FIG. 10. The 25 discs actually utilized would be a subset of the 48 possible discs, which could be fewer or as many as 25 discs. In FIG. 9A, the geometric design shown uses only 12 of the possible 48 discs, namely, those with 2 south poles and 2 north poles where the north poles are next to, rather than across from, each other, i.e., an NNSS configuration. Thus, many of the 12 discs in FIG. 9A are used more than once in the 25-disc array. Further, those discs 150 that are used more than once are often used to represent different hours. Each of the 12 types of discs in FIG. 9A are labeled "A" through "L", as shown. This labeling is for purposes of explanation herein and would not necessarily be provided on actual game pieces 150. For example, there are 4 "D" discs used in the array, once representing 3 o'clock, once representing 6 o'clock, once representing 9 o'clock, and once representing 12 o'clock. Further, different discs are use to represent the same times. For example, 1 o'clock is represented both by a "B" disc and by an "I" disc. The fact that each piece 150 can be rotated into four positions representing four different times makes the solution of the puzzle considerably more challenging. As a disc is rotated, the north/south orientations of the magnets change at the up, down, left and right positions of the disc. The north and south poles of magnets 156 are indicated in FIG. 9A for purposes of explanation only: the pole designations "N" and "S" would not necessarily appear on the faces of game or puzzle pieces 150.

As in the first embodiment, the solution to the geometric puzzle of FIG. 9A, i.e., a selected permutation of the given puzzle pieces 150, would be used to generate a series of 25 integers 160 (FIG. 9B) which can then be used as a cryptographic key, of the Vigenère variety, to decode a ciphertext or encryption 162 which will accompany the puzzle pieces 150. To illustrate a different way of generating the cryptographic key than was used in the first embodiment, the string of 25 numbers in the key 160 could be generated in this embodiment by, starting at the upper left-hand corner of the array, counting the number of clock-face game pieces 150 between each repetition of the unique clocks, i.e., from "A" to the next "A." Thus, a clock or game piece which is used only once in the puzzle would generate the cryptographic-key number 25, because you have to advance 25 game pieces, to the lower right hand corner and then starting again in the upper left hand corner, back to that unique clock or game piece. A particular clock or game piece which is used more than once would generate numbers less than 25 each time that particular game piece appears in the array. See FIG. 9A. Alternatively, as described in the first embodiment, each clock or game piece 150 could have a number (not shown) printed on it that would be used to generate the cryptographic key. Once the series of 25 digits which constitutes the cryptographic key 160 is generated, after the geometric puzzle is solved, the ciphertext or encryption 162 is decoded by subtracting the cryptographic key 160 from the numerical value 164 (A=1, B=2, . . . Z=26) of the letters in the ciphertext or encryption 162. The resulting string of numbers 166 are the numerical values of the alphanumeric cryptographic message 168.

The 25 discs 150 of the puzzle set of this embodiment could be used to form hundreds of different puzzles or geometric designs (including angles defined by arrows or hands 152) of widely varying level of difficulty. For example, besides the 5×5 array, the puzzle pieces can be used to form 1×2, 1×3, 1×5, 2×1, 2×2, 2×3, 2×4, 2×5, 3×1, 3×2, 3×3, 3×4, 3×5, 4×1, 4×2, 4×3, 4×4, 4×5, 5×1, 5×2, 5×3, and 5×4 arrays, as well as a number of other shapes, such as O's, X's, H's, and T's. For each of these arrays, there are a multiplicity of ways which the pieces can be arranged. For example, for the 2×2 array, going from the upper left-hand corner and going across, and finishing with lower right-hand corner, the clocks or game pieces 150 could be arranged so that the hour hands 152 point at the hours of 12, 3, 6, 9 (FIG. 11A); 12, 3, 9, 6 (FIG. 11B); 12, 1, 2, 3 (FIG. 11C); 12, 6, 3, 9 (FIG. 11D); 12, 9, 6, 3 (FIG. 11E), etc. Each of these sequences requires the use of a different subset of the 25 discs of FIG. 9A, or different sequence or rotation of the same subset of discs. Each of the various arrangements for that 2×2 array, as well as the various arrangements for each of the other arrays such as the 3×3 arrays of FIGS. 12A–12D, and the 4×4 arrays of FIGS. 13A–13C, would be illustrated in a booklet 170 (FIG. 11A) which would accompany the puzzle. For each arrangement for each of the various arrays, the booklet 170 would include a distinct ciphertext or encryption which can only be decoded using the cryptographic key generated for the solution for that particular arrangement of that particular array, i.e., for that particular permutation of game pieces 150 reproducing that particular array. In this way, there are literally hundreds of possible puzzles with a distinct cryptographic key and message for each one which can only be decoded when each puzzle is solved. These different arrangements and arrays are of widely varying levels of difficulty, which can be formed using the 25 discs in the puzzle.

A puzzle kit in this embodiment would contain the 25 clock pieces 150, tray 158 in which the clocks can easily rotate, as shown in FIG. 9A, and booklet 170 containing ciphertexts or encryptions to be decoded for deriving the alphanumeric cryptographic messages once the cryptographic keys are generated using the solutions (piece permutations) to the geometric puzzle.

As with the first embodiment, this embodiment could also be manufactured without any internal magnets 156, but with pole markings, such as the letters "S" and "N," on each edge 154 of each piece 150 (see FIG. 9A).

Figure 14:
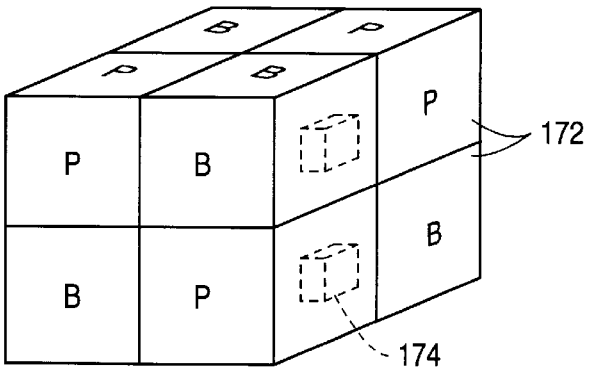
FIG. 14 is an isometric view of a predetermined geometrical design made from eight cubic puzzle or game pieces each having a single color selected from blue (B) and pink (P).

A third embodiment of a game or puzzle with a geometric component and a cryptographic component comprises eight cubes 172 (FIG. 14), four of which have all pink (P) faces and four of which have all blue (B) faces. The object of the geometric/cryptographic puzzle in this embodiment would be to arrange the 8 cubic pieces 172 in various predetermined shapes and sequences (geometrical designs). FIG. 14 shows a particular cubic geometrical design using the eight cubes 172 so that each face of the cubic geometrical design has two blue (B) cubes and two pink (P) cubes, with cubes of like color disposed in diagonal opposition to one another. Each of the six faces of each cube 172 has a magnet 174 in it. The orientation of each magnet 174 in a cube 172 is independent of the orientation of each of the other magnets in the cube. Again, because of the varying internal orientations of the magnets 174 in the faces of each piece 172, the attraction and repulsion caused by the magnets 174 in neighboring cubic pieces make it necessary to have particular cubic pieces in the proper sequence, rotated properly, in order for the pieces to all attract, rather than repel.

Figure 15:
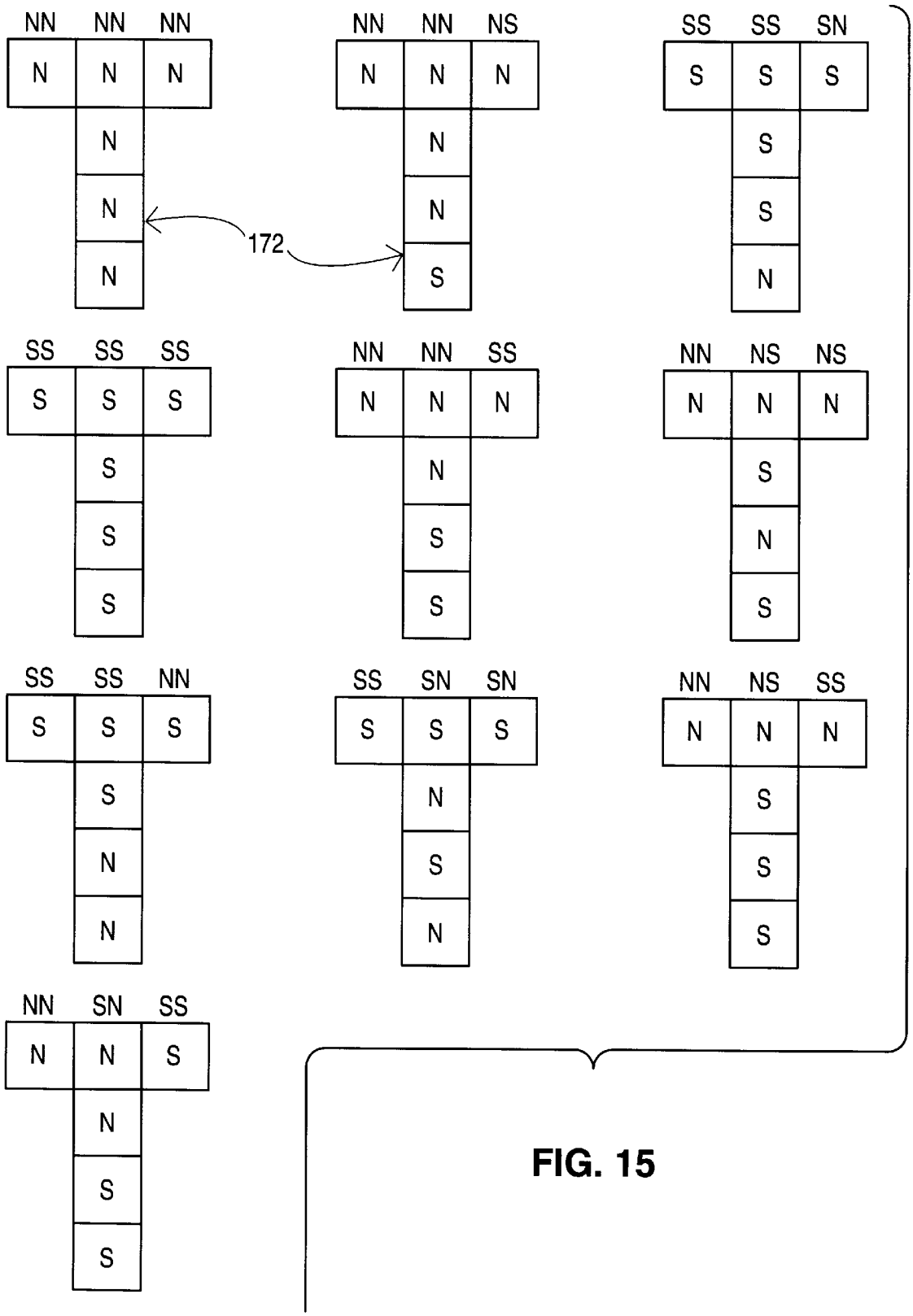
FIG. 15 is a table of all possible cubic game or puzzle pieces shown with sides folded down and with north and south magnetic poles indicated by letters "N" and "S," respectively.
Figure 16:
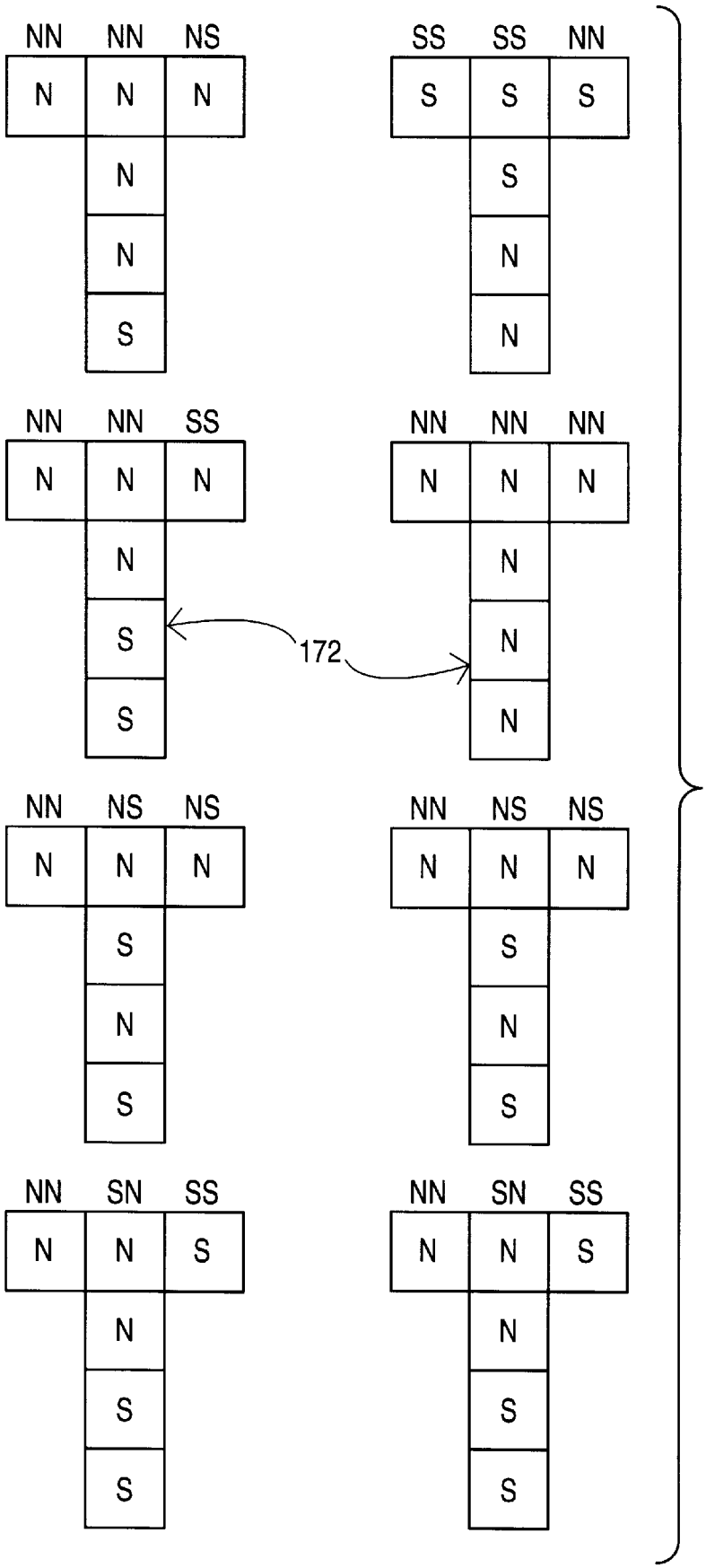
FIG. 16 is a table of eight cubic game or puzzle pieces shown with sides folded down and with north and south magnetic poles as indicated, selected from the possibilities shown in FIG. 15.

As illustrated in FIG. 15, there are ten possible orientations of the six magnets 174 in each cubic piece 170, i.e., one NNNNNN orientation, one NNNNNS orientation, two different NNNNSS orientations, two different NNNSSS orientations, two different NNSSSS orientations, one NSSSSS orientation, and one SSSSSS orientation. Because the pieces 172 are cubes, the NNNNNS orientation is equivalent to the NNNSNN orientation or the SNNNNN orientation by simply rotating the piece. However, the NNNNSS orientation is not equivalent to the NNNSNS orientation, as shown in FIG. 15. For each of the ten orientations, a piece 172 could be one of the two colors pink (P) and blue (B). Thus, in this embodiment there are 20 unique cubic pieces which could be utilized in making the puzzle. The 8 cubic pieces 172 actually utilized for a puzzle set are a subset of these 20 possible pieces with many not used at all and some which could be used more than once. In FIG. 16, the puzzle set shown uses only 6 of the possible 20 cubic pieces 172 and two of the 20 pieces shown in FIG. 16 are used more than once. The fact that each piece 172 can be rotated into six positions makes the solution of the puzzle considerably more challenging. As a cubic piece 172 is rotated, the north/south orientations of the magnets 174 change in the top, bottom, front, back, left and right positions of the cube. The pieces 172 could be made with no external indication of the internal orientations of the magnets in each piece, requiring the user to either test each piece each time it is used to determine which faces are "norths" and which are "souths" or to label the edges in some manner. Alternatively, the pieces 172 could be manufactured already labeled as to the magnetic field orientations of the internal magnets 174. Even so labeled, the puzzles still require significant thought and effort to solve.

As with the first and second embodiment, a permutation or ordered arrangement of the cubic game pieces 172 constituting a solution to the puzzle can be used to generate a series of integers which can then be used as a cryptographic key of the Vigenère variety to decode a ciphertext or encryption which will accompany the geometric puzzle pieces 172. For example, using the method of reading the numbers off of the puzzle pieces to generate the cryptographic key, the numbers can be read starting at the front, lower left hand corner of the large cube (FIG. 14), and then going counter-clockwise (as viewed from the top), around the bottom layer of the large cube; then going to the top, upper left hand corner and again going around the top layer, counter-clockwise. So that plain text longer than 8 characters long can be used, the cryptographic key can be repeated one or more times. Because of the checker board pattern of FIG. 14, any of the four blue cubes can occupy the front, lower left hand corner of the large cube, and for each blue cube, there are three possible pink cubes that can be to the right of it in the front, bottom position. Thus, as with the other embodiments, solving the puzzle at the geometric level does not necessarily solve it at the cryptographic level, and using partial cryptographic keys can be used to help solve the puzzle at the geometric level.

The 8 pieces of the puzzle set of this preferred embodiment are used to form hundreds of different puzzles of widely varying levels of difficulty. For example, besides the color sequence described above for the assembled, large cube, there are 20 other sequences or arrangements of the two colors. For example, the sequence of all pink cubes in the bottom layer and all blue cubes in the top layer.

Further, the cubic puzzle pieces 172 can be used to make a multiplicity of different shapes, each with numerous different color sequences, either using all 8 pieces, or some lesser number. See FIG. 17A–17C for some examples of different shapes or geometric designs using all of the pieces. In this way, there could be literally hundreds of possible puzzles with a distinct cryptographic key and ciphertext message for each one which can only be decoded when each puzzle is solved. These different shapes and sequences are of widely varying levels of difficulty, which can be formed using the 8 pieces in the puzzle.

Depending on the particular set of puzzle pieces, some shapes and color sequences (geometric designs) can be extraordinarily difficult to construct. For example, if a puzzle set comprising cubic game pieces having only 12 faces with south (S) poles is used to construct the large cube with the color sequence shown in FIG. 14, there are only a small number of solutions to the puzzle. All of the south (S) faces must be contiguous to one of 36 faces provided with a north (N) magnetic pole. Thus, with this puzzle set, to make a large 2×2×2 cube with any color sequence, no faces with a south pole can face in an outward direction because there would then be an insufficient number of south pole faces to match with 12 north pole faces needed to form the large cube. Puzzle sets can be made that can make the large cube of FIG. 14 with any number of S faces ranging from 12 to 36, with those at the extremes being the most difficult to solve, and puzzles with 24 S faces being the easiest to solve. The difficulty of solving the puzzles when the puzzle sets contain an extremely high or low number of S faces can, however, be reduced by using portions of the cryptographic key generated as possible solutions to the color sequence as constructed. If the key produces text from the ciphertext which is clearly not words or parts of words, then that partial solution to the color sequence may then be rejected. In this manner, the cryptographic component of these puzzles not only increases the interest in solving the color sequence in order to decode the message, but it also can be used to simplify puzzles which could otherwise be inordinately difficult to solve.

Figure 18C:
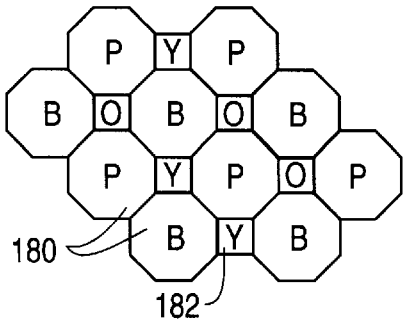
FIG. 18C is a top plan view or graphic representation of six square game or puzzle pieces and ten hexagonal game or puzzle pieces arranged in a predetermined geometric configuration with colors pink (P), blue (B), yellow (Y), and orange (O) as indicated.
Figure 19A:
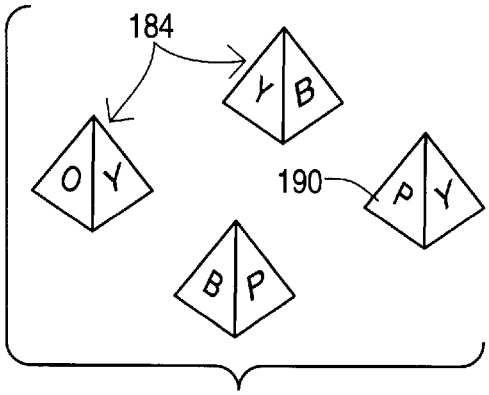
FIG. 19A is an isometric view of four pyramidal geometrical designs each formed with a plurality of triangular puzzle pieces having different colors taken from among the colors pink (P), blue (B), yellow (Y), and orange (O), as indicated.
Figure 19B:
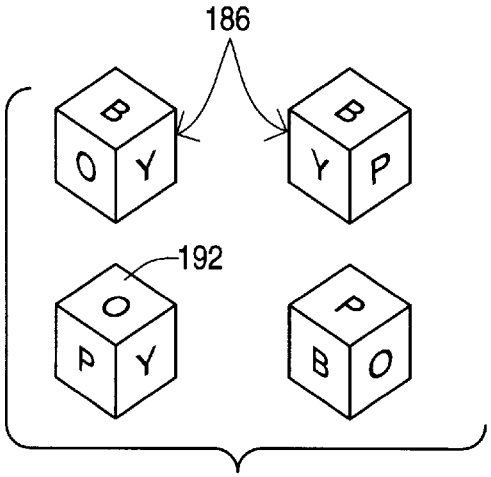
FIG. 19B is an isometric view of four cubic geometrical designs each formed with a plurality of square game or puzzle pieces having different colors taken from the group of colors including pink (P), blue (B), yellow (Y), and orange (O), as indicated.
Figure 20:
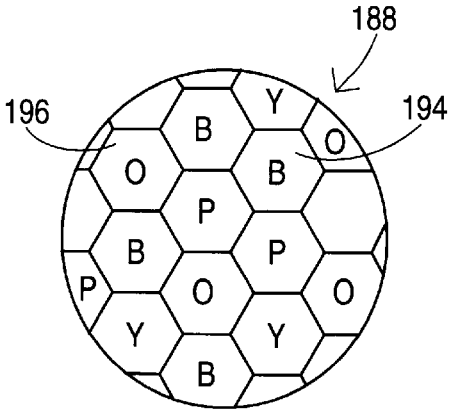
FIG. 20 is an isometric view of a predetermined geometric configuration generally in the form of a sphere made from a plurality of hexagonal and pentagonal game pieces having different colors, as indicated.

Other embodiments of the invention include puzzles where all the pieces are planar squares 176 (FIG. 18A), pentagons (not shown), hexagons 178 (FIG. 18B), octagons, etc. In addition, puzzles using a combination of different shapes could also be made, such as octagons 180 and squares 182 (FIG. 18C). Further, puzzles forming three-dimensional hollow solids, such as pyramids 184 (FIG. 19A), cubes 186 (FIG. 19B), dodecahedrons (not shown), geodesic constructions or spheres such as a soccer ball 188 (FIG. 20), where each of the pieces is a two-dimensional geometric shape, such as a triangle 190 (FIG. 19A), a square 192 (FIG. 19B) or pentagons 194 and hexagons 196 (FIG. 20) or curved two-dimensional shapes, are other possible embodiments. Other embodiments include ones in which the pieces are themselves three-dimensional, which can form various three dimensional objects when solved.

Figure 21:
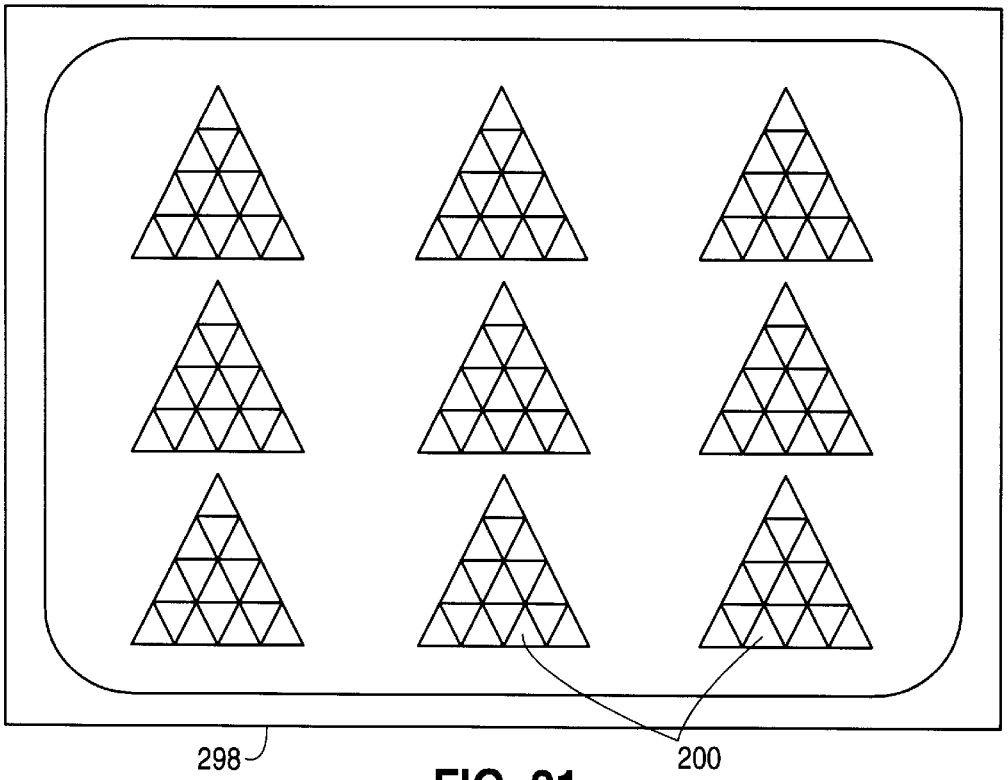
FIG. 21 is a schematic view of a computer monitor screen, showing geometrical puzzle designs for selection by a player.

Any embodiment of the puzzles described above can be realized by a specially programmed computer. In a computer version of the puzzle, the player is presented on a computer monitor 198 (FIG. 21) with a library of possible puzzles to solve, comparable to a table of contents for a booklet which accompanies the physical versions of the puzzle described above. As illustrated in FIG. 21, various possible puzzles, particularly the geometrical design components 200 thereof, can be displayed in a Form #1 on monitor 198. Each geometrical puzzle component 200 shown in FIG. 21 is an equilateral triangle of four different colors (not indicated) arranged in a respective sequence or design. A single computer version could, of course, include puzzles with different 2- and 3-dimensional shapes.

The player selects a puzzle 200 to solve by clicking a mouse (not shown) or by other means. Once a puzzle is selected, Form #1 disappears from the computer monitor 198 and a Form #2 appears, illustrated in FIG. 22. Form #2 displays in the upper left hand corner the puzzle 202 selected by the player from Form #1 (FIG. 21). In the upper right hand corner of Form #2 (FIG. 22), the game set of pieces 204 to be used in solving the selected puzzle 202 is displayed. As explained above in describing the physical versions of the puzzle, there are many possible sets of game pieces for each geometrical design 200. Thus, in the computer version, not only may the player select a puzzle to solve, but he/she may also select different game sets of pieces, of varying difficulties, to use to solve the puzzle selected. For example, the player could first solve a particular puzzle with a game set of pieces with an equal number of south and north edges. Puzzles with those game sets of pieces are relatively easy to solve because there are numerous possible solutions. The player could then select a more difficult game set of pieces, e.g. where there are far more south edges than north edges, and using that game set attempt to solve the same puzzle, i.e. the same geometric shape and the same sequence of colors. The lower left hand corner of Form #2 (FIG. 22) is a work area 206 where pieces from the game set of pieces are moved, assembled and rotated to form the puzzle selected. The lower right hand corner of Form 2 is the cryptographic area 208 which displays (i) a ciphertext or encryption to be solved in a cryptographic component of a composite puzzle, (ii) space for the cryptographic key to be displayed, and (iii) a plaintext message, as the cryptographic key is derived. Because for many of the game sets of pieces there are many possible solutions for any of the possible color sequences of puzzle pieces, there can be many different cryptographic keys generated for a given color sequence of puzzle pieces and a given set of game pieces. Thus, after solving a particular color sequence with a particular game set of pieces, a player could choose to play the same color sequence and game set, but select a new ciphertext to solve. The computer version would provide many different ciphertexts for each combination of color sequences and game sets. In a game set including physical or solid game pieces (as opposed to electronically encoded game pieces), a booklet could also provide the player with multiple ciphertexts or encryptions associated separately with the same geometrical design to form respective geometrical/cryptographic puzzles.

The playing of the computer version of the puzzle is straightforward. After selecting a composite puzzle to solve, i.e. a geometric shape and sequence of colors (see FIG. 21), a game set of pieces, and a ciphertext, the player starts moving pieces from the game set display 204 on Form #2 to work area 206. This is accomplished by clicking the mouse on a selected game piece in the game set display 204 and dragging the mouse to the position in the work area 206 where the player wants to place the piece. The computer then erases that piece from the game set area 204, and displays it in the work area 206 where the player has placed it. In addition, the computer then enters whatever information in the cryptographic area 208, i.e. cryptographic key and plaintext displays, that placement of that particular piece in that particular location of the puzzle generates. If the edges do not match, the computer flashes the pieces with non-matching edges and displays the message "Edges don't match." The player can then rotate one of the non-matching pieces by double-clicking the mouse on that piece until all the sides match. If rotating the one piece does not eliminate the non-matching condition, that or other pieces may be returned to the game set display area 204 by clicking the mouse on the piece to be returned and dragging it back to the game set display area. In addition, even if the edges match, the player may be able to see that the partial solution of the puzzle is generating a partial cryptographic key which is clearly wrong because the resulting partial plaintext is not sensible. The player would in that case also return that or other game pieces to the game set of pieces display area 204. The puzzle is solved and the ciphertext is decoded by moving the pieces from the game set of pieces area to the work area, rotating them if necessary, and checking to see if the resulting plaintext is possible.

Figure 23:
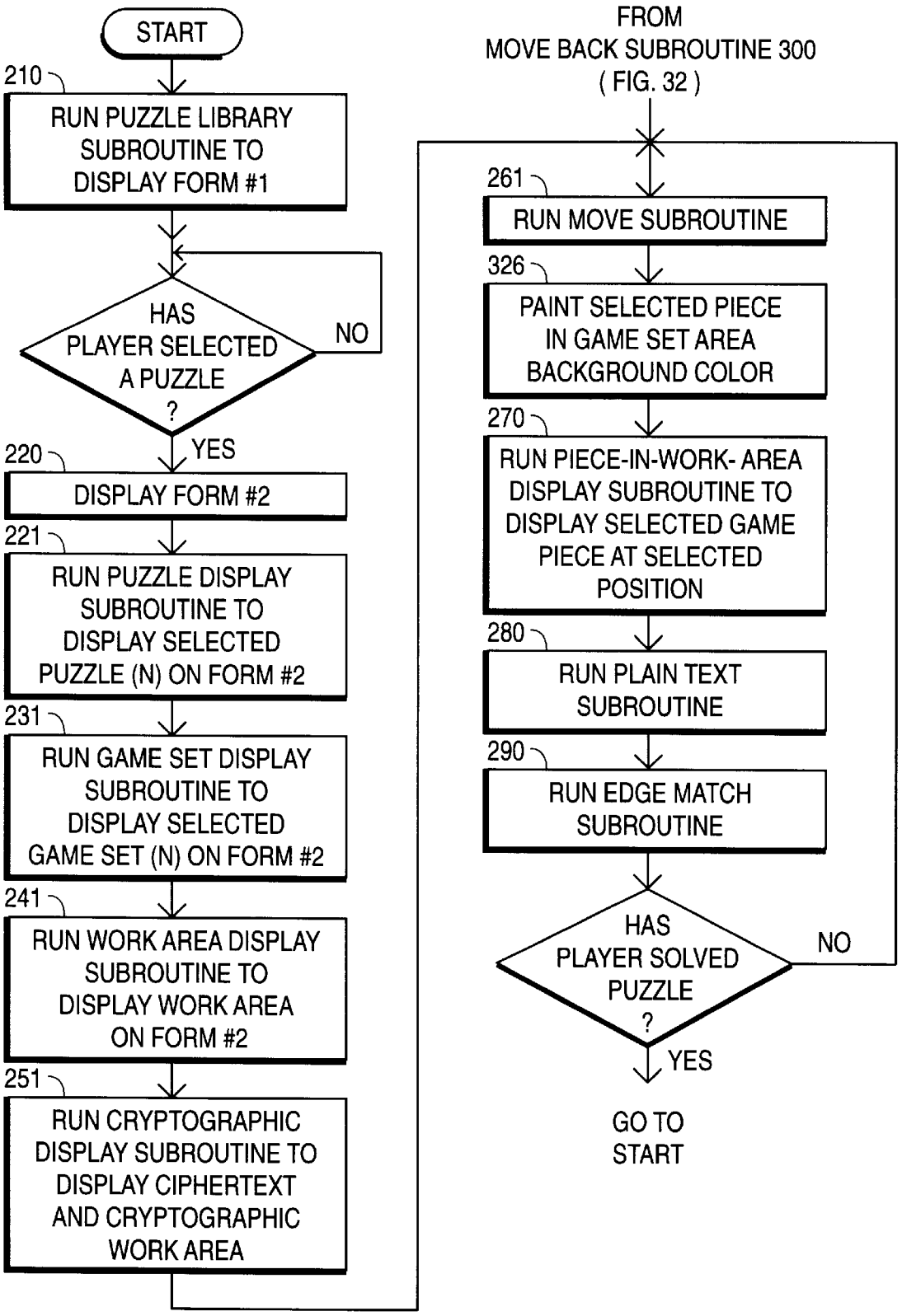
FIG. 23 is a is flow chart diagram of subroutines executed by a microprocessor in enabling the display of FIG. 21 and the playing of a selecting game or puzzle in the display of FIG. 22.

The following is a more detailed explanation of microprocessor operation in the computer version of a combination geometrical and cryptographic puzzle game. Upon initialization 209 (FIG. 23), the microprocessor displays a first page of a puzzle library, Form #1, page #1, on the computer monitor 298 (see FIG. 21). Each page of the puzzle library consists of a display of a fixed number (e.g. 9, 12) of geometric puzzles 200. The microprocessor produces the puzzle library display by executing a puzzle library subroutine 210 (FIGS. 23 and 24).

Figure 24:
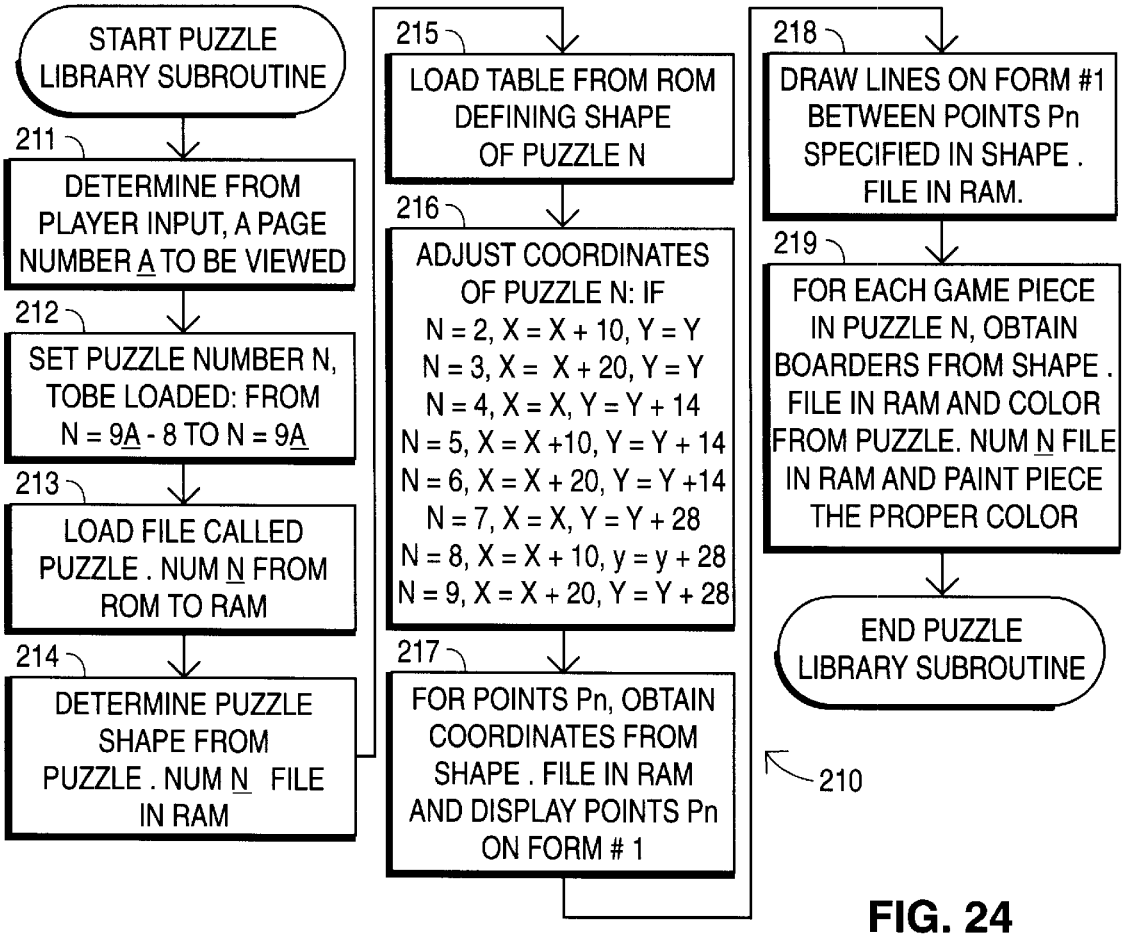
FIG. 24 is a flow chart diagram of a puzzle library subroutine shown in FIG. 23.

As illustrated in detail in FIG. 24, puzzle library subroutine 210 begins with selecting a page number A for display in a step 211. The initial page is page #1. In a subsequent step 212, the microprocessor sets the puzzle number, N, to be displayed on Form #1 (FIG. 21) equal to 9A−8, or 1, i.e. (9×1−8). Then, in a step 213, the microprocessor creates a file or area in RAM called "Puzzle.Num" and loads into it a file, Puzzle.Num1, from ROM. As shown in Table I, a Puzzle.Num file identifies the colors for the different triangle positions of a particular geometrical puzzle design. The microprocessor then reads the Puzzle.Num file in RAM in a step 214 to determine the geometrical shape to be displayed. In this example, the shape corresponding to Puzzle.Num1 is "Triang," i.e. the puzzle to be solved is a large equilateral triangle made up of 16 small equilateral triangles, as shown in FIGS. 1 and 21. In a subsequent step 215, the microprocessor creates a file in RAM called "Shape." and loads into it a file, "Shape.Triang," from ROM, because the shape of the first puzzle (Puzzle.Num1) is triangular. Table II shows the contents of the file Shape.Triang.

TABLE I

Puzzle Number 1

Shape Triang
Pieces 16

| Position | Color |
|---|---|
| PosA | Pink |
| PosB | Blue |
| PosC | Orange |
| PosD | Yellow |
| PosE | Pink |
| PosF | Blue |
| PosG | Orange |
| PosH | Yellow |
| PosI | Pink |
| PosJ | Blue |
| PosK | Orange |

TABLE I-continued

| Puzzle Number 1 | |
|---|---|
| Shape Triang Pieces 16 | |
| Position | Color |
| PosL | Yellow |
| PosM | Pink |
| PosN | Blue |
| PosO | Orange |
| PosP | Yellow |

One way the microprocessor could display, on Form #1 (FIG. 21), the geometrical design encoded in the Puzzle-.Num1 file is to have, in the Shape.Triang file, a bit map of the small equilateral triangle piece and coordinates on Form #1 where each of the 16 game pieces is to be placed. The microprocessor would then go through the list of coordinates for the game pieces and display copies of the bit map of the game piece at each location on Form #1. Another way, shown in Table II, is a vector approach. The Shape.Triang file contains the coordinates for all the vertices or points of the geometrical design defined in the Puzzle.Num1 file. To construct the large equilateral triangle, 15 points must be specified, Pn=P1 to P15. From the Shape. RAM file, the microprocessor successively reads, in a step 217, coordinates CoordX and CoordY of each point Pn, for n=1 to 15, and displays the points on Form #1. The microprocessor then draws straight lines between the appropriate points, by reading lines ("Lines") from the Shape. RAM file. There are 30 lines connecting the 15 points Pn to make the large equilateral triangle, so Lines=30 in that file. The microprocessor then reads from the Shape. RAM file for each of the 30 lines, L1 to L30, the two points, PA and PB, that are to be connected. For example, for line L1 in Table II, PA=P1 and PB=P2. The microprocessor then finds the coordinates CoordX and CoordY for P1 and P2 in the Shape. RAM file and draws a straight line between these points on Form #1. The microprocessor similarly draws the rest of the 30 lines in this example (step 218). The first geometrical puzzle design, encoded in the Puzzle.Num1 file, is now displayed in Form #1, except that the small equilateral triangle pieces must be appropriately colored.

TABLE II

| Shape. Triang | | | | | | | | | | | |
|---|---|---|---|---|---|---|---|---|---|---|---|
| Shape Point | Triang Coord X | Points Coord Y | 15 Pos@ | Lines Mid X | 30 Mid Y | Pieces Border LA | 16 LB | LC | Line | PA | PB |
| P1 | 1 | 10 | PosA | 2 | 29 | L1 | L5 | L6 | L1 | P1 | P2 |
| P2 | 3 | 10 | PosB | 3 | 28.5 | L6 | L7 | L13 | L2 | P2 | P3 |
| P3 | 5 | 10 | PosC | 4 | 29 | L2 | L7 | L8 | L3 | P3 | P4 |
| P4 | 7 | 10 | PosD | 5 | 28.5 | L8 | L9 | L14 | L4 | P4 | P5 |
| P5 | 9 | 10 | PosB | 6 | 29 | L3 | L9 | L10 | L5 | P1 | P6 |
| P6 | 2 | 8 | PosF | 7 | 28.5 | L10 | L11 | L15 | L6 | P2 | P6 |
| P7 | 4 | 8 | PosG | 8 | 29 | L4 | L11 | L12 | L7 | P2 | P7 |
| P8 | 6 | 8 | PosH | 3 | 28.5 | L13 | L16 | L17 | L8 | P3 | P7 |
| P9 | 8 | 8 | PosI | 4 | 29 | L17 | L18 | L22 | L9 | P3 | P8 |
| P10 | 3 | 6 | PosJ | 5 | 27 | L14 | L18 | L19 | L10 | P4 | P8 |
| P11 | 5 | 6 | PosK | 6 | 26.5 | L19 | L20 | L23 | L11 | P4 | P9 |
| P12 | 7 | 6 | PosL | 7 | 27 | L15 | L20 | L21 | L12 | P5 | P9 |
| P13 | 4 | 4 | PosM | 4 | 25 | L22 | L24 | L25 | L13 | P6 | P7 |
| P14 | 6 | 4 | PosN | 5 | 24.5 | L25 | L26 | L28 | L14 | P7 | P8 |
| P15 | 5 | 2 | PosO | 6 | 25 | L23 | L26 | L27 | L15 | P8 | P9 |
| | | | PosP | 5 | 23 | L28 | L29 | L30 | L16 | P6 | P10 |
| | | | | | | | | | L17 | P7 | P10 |
| | | | | | | | | | L18 | P7 | P11 |
| | | | | | | | | | L19 | P8 | P11 |
| | | | | | | | | | L20 | P8 | P12 |
| | | | | | | | | | L21 | P9 | P12 |
| | | | | | | | | | L22 | P10 | P11 |
| | | | | | | | | | L23 | P11 | P12 |
| | | | | | | | | | L24 | P10 | P13 |
| | | | | | | | | | L25 | P11 | P13 |
| | | | | | | | | | L26 | P11 | P14 |
| | | | | | | | | | L27 | P12 | P14 |
| | | | | | | | | | L28 | P13 | P14 |
| | | | | | | | | | L29 | P13 | P15 |
| | | | | | | | | | L30 | P14 | P15 |

To effectuate coloration (step 219), the microprocessor reads position Pos=16 from the Shape. RAM. Then, for position PosA to position PosP, the microprocessor finds the borders ("Borders")—lines LA, LB, and LC—from the Shape. RAM file. See Table II. The Borders are the Lines which define each position of the puzzle. For example, in the Shape.Triang file, the Borders for position Pos1 are lines L1, L5 and L6. These three lines define a small equilateral triangle which is now ready to be painted by the microprocessor. The microprocessor determines what color to paint the triangle by reading from the Puzzle.Num RAM file the color ("Color") for position PosA—in this example, pink. See Table I. The microprocessor then proceeds to paint the other 15 positions (triangles) for the first puzzle Puzzle.Num1, and displays the results on Form #1. The first puzzle, Puzzle.Num1, is now complete on Form #1.

After the first geometrical puzzle design has been displayed as described above, the microprocessor then performs the same process for the remaining geometrical puzzle designs of the first page of Form #1, and to that end accesses files Puzzle.Num2 through Puzzle.Num9 in the case of nine designs on a display page. The only difference in the process for the other geometrical puzzle designs to be displayed on Form #1, Page #1, is that the coordinates for the points must be adjusted for the other eight puzzles. This is because the coordinates CoordX and CoordY of the Points Pn=P1 to P15, are always stored in the Shape. ROM files for display in the upper left hand corner of the computer monitor, which, as is explained below, is where the puzzles are always displayed on Form #2 once a puzzle to be solved is selected by the player. To display the other puzzles in other locations on Form #1 on the monitor, a factor must be added to each X coordinate CoordX and/or to each Y coordinate CoordY. For example, for Puzzle.Num2, the value 10 must be added to each X coordinate CoordX, so that the microprocessor will properly display that puzzle at the top of Form #1, just to the right of the first geometrical puzzle design (Puzzle.Num1). For the ninth puzzle encoded in the Puzzle-.Num9 file, on the other hand, the microprocessor must add 20 to all X coordinates and 28 to all Y coordinates so that the ninth puzzle will be displayed on Form #1 at the bottom right hand corner of the computer screen. The microprocessor makes these adjustments to the coordinates in a step 216 right after it creates the Shape. file in RAM, and before it displays the points Pn from that file on Form #1.

To see a different page of puzzles, the player can set the page number, A, to a different value. The microprocessor will then display nine other puzzles on Form #1, Puzzle.Num(9A−8) to Puzzle.Num(9A).

On any given page of the puzzle library, the color sequences of these other puzzles may all be different, the shape of large puzzles may all be different, and the shape and number of small game pieces may all be different. See, e.g. Form #1, FIG. 21.

The player selects a puzzle to solve by clicking the mouse when the curser is within the borders of the desired geometrical design in Form #1. The microprocessor then erases Form #1 from the computer monitor screen and replaces it with Form #2, discussed above with reference to FIG. 22. Form #2 consists of five different areas. The Puzzle Display 202, in the upper left hand corner, is the puzzle the player selected from the puzzle library. In the upper right hand corner of Form #2 the game set pieces 204 to be used in solving the puzzle is displayed. In the example shown in FIG. 22, there are 16 small equilateral triangular game pieces in piece display area 204. Because there can be many different sets of game pieces, as explained above, of varying difficulty to solve particular puzzles, the player will be able to choose among different sets of game pieces to be used for the same geometrical puzzle selected. In the lower left hand corner of Form #2 the work area 206 is displayed. It consists of the unpainted Shape of the puzzle selected. To solve the puzzle, the player moves game pieces from the game set area 204 to the work area 206. In the lower right hand corner is the Cryptographic Work Area 208. The area 208 has a line for the ciphertext to be solved, a line for the numerical value of the ciphertext, a line for the cryptographic key used to solve the ciphertext, a line for the numerical value of the plaintext and a line for the plaintext. Finally, at the very bottom of Form #2 a table may be displayed showing the numerical value of each of the letters of the alphabet.

Figure 25:
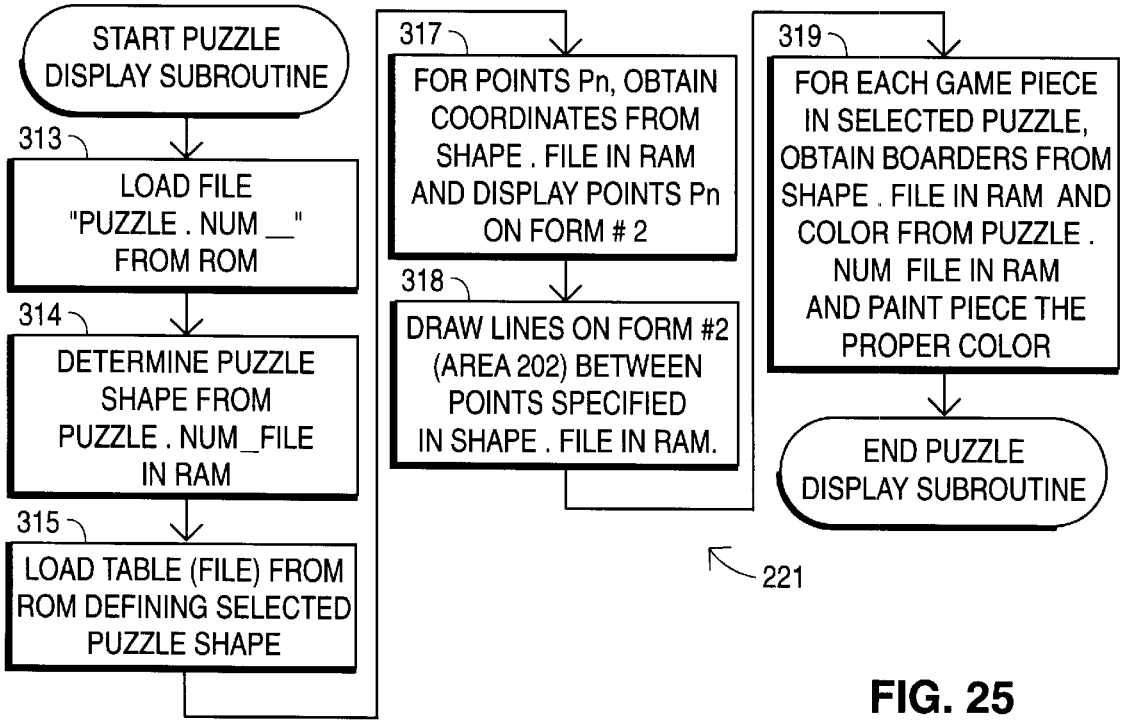
FIG. 25 is a flow chart diagram of a puzzle display subroutine shown in FIG. 23.
Figure 28:
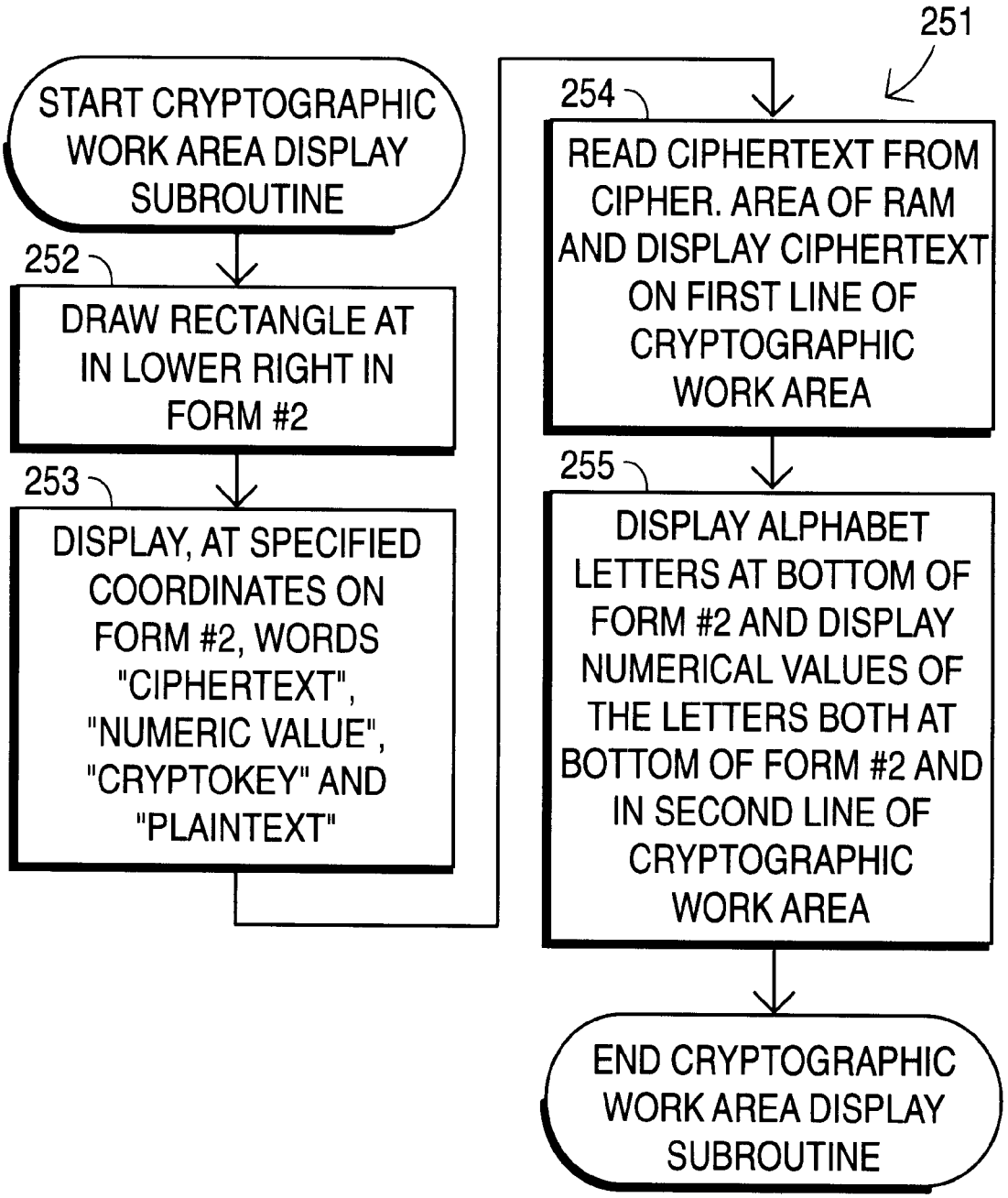
FIG. 28 is a flow chart diagram of a cryptographic work area subroutine shown in FIG. 23.

As shown in FIG. 23, the microprocessor creates Form #2 on the computer monitor 298 by running five subroutines, a puzzle display subroutine 221, a game set subroutine 231, a work area subroutine 241, a cryptographic work area subroutine 251, and a numerical value subroutine 255 (FIG. 28). The puzzle display subroutine 221, shown in FIGS. 23 and 25, is virtually identical to the puzzle library subroutine 210 (FIGS. 23 and 24) except that only the puzzle selected is displayed, rather than nine puzzles, and the selected puzzle is displayed in the upper left hand corner, like the first geometrical puzzle design (Puzzle.Num1) of the library page, regardless of where the selected puzzle was displayed on Form #1. Thus, puzzle display subroutine 221 does not make any adjustments to the coordinates of the points Pn, as did the puzzle library subroutine 210, because all of the Shape. files in ROM, as explained above, have the points Pn set to display in the upper left hand corner.

As illustrated in FIG. 25, puzzle display subroutine 221 includes steps 313–315 and 317–319 which are essentially identical to respective steps 213–215 and 217–219 in puzzle library subroutine 210. Further explanation of puzzle display subroutine 221 is omitted here.

Figure 26:
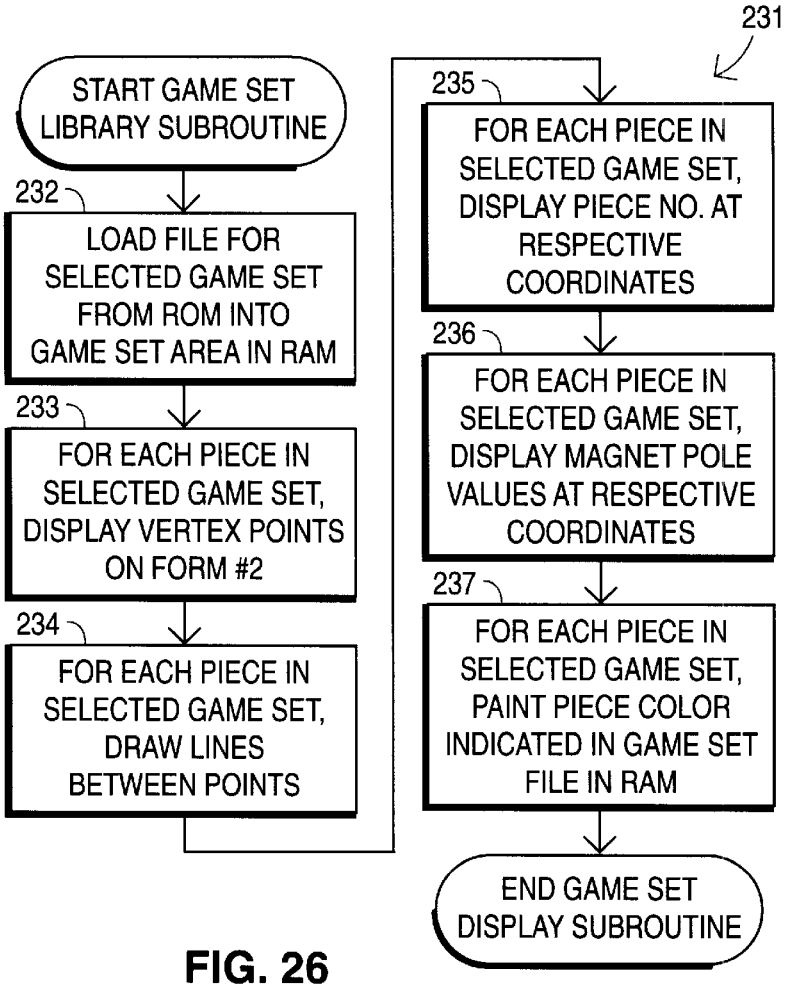
FIG. 26 is a flow chart diagram of a game set display subroutine shown in FIG. 23.

Game set display subroutine 231 displays each piece of the set of game pieces that are to be used to solve the puzzle selected. Each piece is shown painted its proper color, identified by number, and with each side of each piece labeled with its edge marking, such as "N" for a north magnetic pole and "S" for a south magnetic pole in the "magnetic" version of the puzzle. Key steps of game set display subroutine 231 are depicted in the flow chart diagram of FIG. 26. In executing game set display subroutine 231, the microprocessor reads from the Shape. RAM area the Shape.Triang file, and then creates loads a file called "GameSet.Triang1" from ROM into a GameSet. area in RAM in a step 232. If the player wants a different game set, i.e. a different group of game pieces, for use in solving the geometrical puzzle selected, he/she enters a different number, M, and the microprocessor will then load a different file, GameSet.TriangM, into the GameSet. area in RAM. The microprocessor then proceeds, using the information now in the GameSet. RAM area, to display the game set of pieces selected. Again, the GameSet.TriangM file may contain a bit map of the small equilateral triangle game pieces and the set of coordinates where the game pieces are to be displayed on Form #2. Alternatively, as with the puzzle library and puzzle display, the GameSet.TriangM file can contain the coordinates for the corners of each piece—PiecCorX1, PiecCorY1, PiecCorX2, PiecCorY2, PiecCorX3, and PiecCorY3. See Table III. In a step 233, the microprocessor reads each set of coordinates for each piece from the GameSet. RAM file and displays a point on Form #2 for each set of coordinates. Then, in a step 234, the microprocessor draws lines for each piece between each point and the adjacent points. In a subsequent step 235, the microprocessor displays the number of each piece PiecNum from the GameSet. RAM file at coordinates NumCorX, NumCorY on Form #2. Next, in a step 236, the edge markings of each piece are displayed by, for each piece, finding in the GameSet. file the magnetic pole values MagnetA, MagnetB, and MagnetC, and displaying those values at coordinates MagCorX1, MagCorY1, MagCorX2, MagCorY2, and MagCorX3, MagCorY3, respectively. Finally, in a step 237, each piece is painted by the microprocessor the color indicated for that piece in the GameSet. RAM file.

TABLE III

| Game Set 1 | | | | | | | | | | | | | | | | |
|---|---|---|---|---|---|---|---|---|---|---|---|---|---|---|---|---|
| GameSet 1 | | | | | | | | | | | | | | | | |
| PiecNum | 1 | 2 | 3 | 4 | 5 | 6 | 7 | 8 | 9 | 10 | 11 | 12 | 13 | 14 | 15 | 16 |
| Color | P | O | Y | O | Y | P | P | O | B | B | P | B | Y | B | O | Y |
| MagnetA | N | N | N | N | N | N | N | N | N | N | N | N | N | N | N | N |
| MagnetB | N | N | N | S | S | S | S | S | N | N | N | N | N | N | N | S |
| MagnetC | S | S | S | S | S | S | S | S | S | S | S | N | S | S | N | S |
| PiecType | B | B | B | C | C | C | C | C | B | B | B | A | B | B | A | C |
| PiecCorX1 | 17 | 21 | 25 | 29 | 17 | 21 | 25 | 29 | 17 | 21 | 25 | 29 | 17 | 21 | 25 | 29 |
| PiecCorY1 | 2 | 2 | 2 | 2 | 6 | 6 | 6 | 6 | 10 | 10 | 10 | 10 | 14 | 14 | 14 | 14 |
| PiecCorX2 | 16 | 20 | 24 | 28 | 16 | 20 | 24 | 28 | 16 | 20 | 24 | 28 | 16 | 20 | 24 | 28 |
| PiecCorY2 | 4 | 4 | 4 | 4 | 8 | 8 | 8 | 8 | 12 | 12 | 12 | 12 | 16 | 16 | 16 | 16 |
| PiecCorX3 | 18 | 22 | 26 | 30 | 18 | 22 | 26 | 30 | 18 | 22* | 26 | 30 | 18 | 22 | 26 | 30 |
| PiecCorY3 | 4 | 4 | 4 | 4 | 8 | 8 | 8 | 8 | 12 | 12 | 12 | 12 | 16 | 16 | 16 | 16 |
| MagCorX1 | 16.5 | 20.5 | 24.5 | 28.5 | 16.5 | 20.5 | 24.5 | 28.5 | 16.5 | 20.5 | 24.5 | 28.5 | 16.5 | 20.5 | 24.5 | 28.5 |
| MagCorY1 | 3 | 3 | 3 | 3 | 7 | 7 | 7 | 7 | 11 | 11 | 11 | 11 | 15 | 15 | 15 | 15 |
| MagCorX2 | 17.5 | 21.5 | 25.5 | 29.5 | 17.5 | 21.5 | 25.5 | 29.5 | 17.5 | 21.5 | 25.5 | 29.5 | 17.5 | 21.5 | 25.5 | 29.5 |
| MagCorY2 | 3 | 3 | 3 | 3 | 7 | 7 | 7 | 7 | 11 | 11 | 11 | 11 | 15 | 15 | 15 | 15 |
| MagCorX3 | 17 | 21 | 25 | 29 | 17 | 21 | 25 | 29 | 17 | 21 | 25 | 29 | 17 | 21 | 25 | 29 |
| MagCorY3 | 4 | 4 | 4 | 4 | 8 | 8 | 8 | 8 | 12 | 12 | 12 | 12 | 16 | 16 | 16 | 16 |
| NumCorX | 17 | 21 | 25 | 29 | 17 | 21 | 25 | 29 | 17 | 21 | 25 | 29 | 17 | 21 | 25 | 29 |
| NumCorY | 3 | 3 | 3 | 3 | 7 | 7 | 7 | 7 | 11 | 11 | 11 | 11 | 15 | 15 | 15 | 15 |

Figure 27:
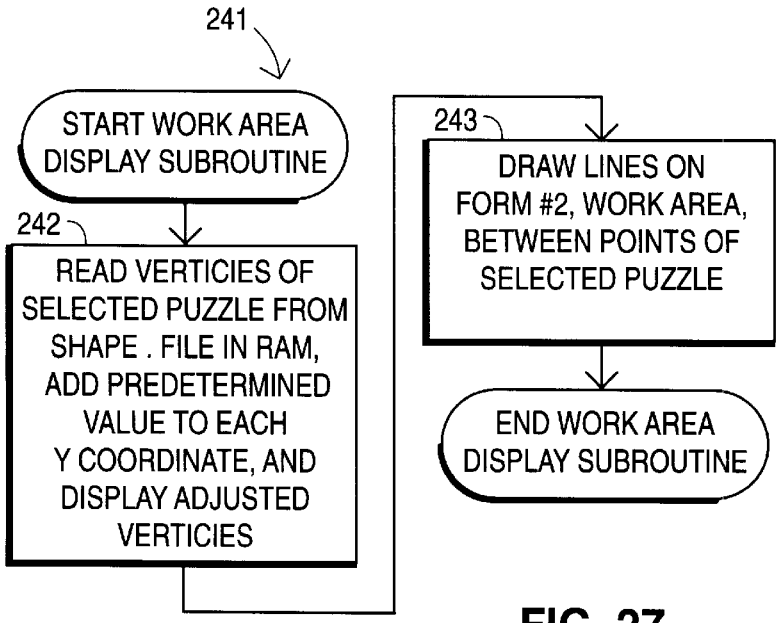
FIG. 27 is a flow chart diagram of a work area display subroutine shown in FIG. 23.

In executing work area display subroutine 241, the microprocessor displays the puzzle selected, unpainted, in the lower left hand corner of Form #2. Key steps of work area display subroutine 241 are depicted in the flow chart diagram of FIG. 27. Like puzzle library subroutine 210 and puzzle display subroutine 221, work area display subroutine 241 directs the microprocessor to read the vertices of the puzzle, points Pn, from the Shape. file in RAM. Before displaying the vertices, however, the microprocessor adjusts the vertex coordinates in a step 242 by adding 20 to each Y coordinate CoordY so that the vertices will be displayed at the appropriate places on Form #2. Pursuant to a step 243 of work area display subroutine 241, the microprocessor then draws the lines between the appropriate vertex points, in the same manner as puzzle library subroutine 210. Following work area display subroutine 241, the microprocessor also creates a file, WorkArea., in RAM by loading that file from ROM. See Table VI.

TABLE VI

| Work Area | | | | | | |
|---|---|---|---|---|---|---|
| Pos@ | PiecNum | Color | MagnetA | MagnetB | MagnetC | PiecType |
| PosA | 6 | P | N | S | S | C |
| PosB | 11 | P | N | N | S | B |
| PosC | 1 | P | N | N | S | B |
| PosD | 7 | P | N | S | S | C |
| PosE | 14 | B | N | N | S | B |

TABLE VI-continued

| Work Area | | | | | | |
|---|---|---|---|---|---|---|
| Pos@ | PiecNum | Color | MagnetA | MagnetB | MagnetC | PiecType |
| PosF | | | | | | |
| PosG | | | | | | |
| PosH | | | | | | |
| PosI | | | | | | |

TABLE VI-continued

| Work Area | | | | | | |
|---|---|---|---|---|---|---|
| Pos@ | PiecNum | Color | MagnetA | MagnetB | MagnetC | PiecType |
| PosJ | | | | | | |
| PosK | | | | | | |
| PosL | | | | | | |
| PosM | | | | | | |
| PosN | | | | | | |
| PosO | | | | | | |
| PosP | | | | | | |

Figure 22:
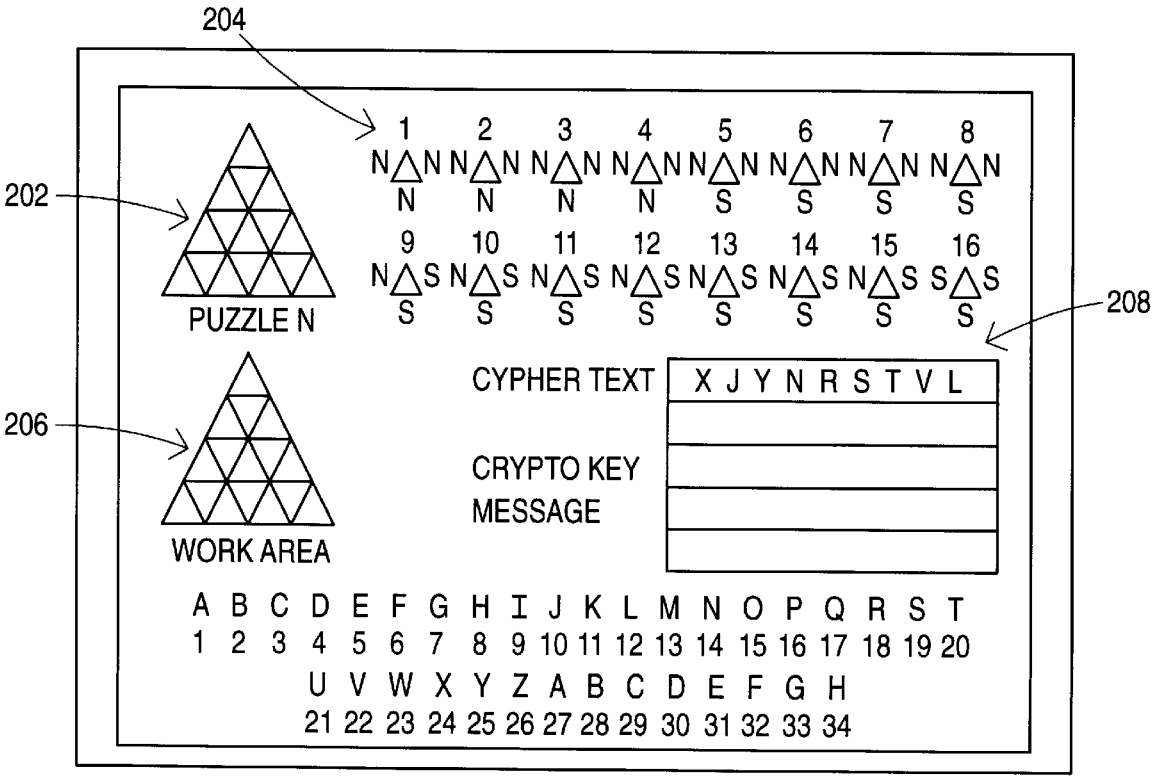
FIG. 22 is a schematic view of a computer monitor screen, showing a display for playing a game selected from the geometrical puzzle designs of FIG. 21.

Cryptographic work area display subroutine 251 controls the microprocessor to display cryptographic work table 208 in the lower right hand corner of Form #2 (see FIG. 22). As indicated at 252 and 253 in FIG. 28, the microprocessor first draws a rectangle at that location and then writes the labels "Ciphertext", "Numerical Value", "Cryptographic Key" and "Plaintext" on separate lines at the left side of the rectangle. Pursuant to cryptographic work area display subroutine 251, the microprocessor then creates a file, "Cipher.," in RAM by loading a file "CipherText" from ROM. See Table IV. In a step 254, the microprocessor displays on the ciphertext line of the rectangle the first ciphertext or encryption listed in the Cipher. area of RAM for the player-selected geometrical puzzle (identified by the Puzzle.NumN file) and the player selected set of game pieces (identified by the GameSet.TriangM file). As discussed above in the description of the first embodiment, many puzzles with particular game sets have multiple solutions, each of which can generate a different cryptographic key. Further, as also explained above, there are many ways to generate a cryptographic key from the same sequence of game pieces. Thus, for a given geometrical puzzle design, Puzzle N, and a given set of game pieces, Game Set M, there can be numerous ciphertexts to solve. The player can choose a different ciphertext, L, to solve for Puzzle N, and GameSet M. The microprocessor will thus find and display player-selected ciphertext L in the cryptographic work area 208 (FIG. 22).

TABLE IV

Ciphertext For Puzzles

| CipherText | | | | | | | | | | | | | | | | |
|---|---|---|---|---|---|---|---|---|---|---|---|---|---|---|---|---|
| Position | 1 | 2 | 3 | 4 | 5 | 6 | 7 | 8 | 9 | 10 | 11 | 12 | 13 | 14 | 15 | 16 |
| Puzzle | 1 | | | | | | | | | | | | | | | |
| Gameset | 1 | | | | | | | | | | | | | | | |
| CipherTextA | F | T | S | M | T | V | I | I | A | N | R | F | L | A | T | E |
| CipherTextB | G | B | R | E | D | J | I | L | V | C | X | A | Y | R | W | F |
| Puzzle | 2 | | | | | | | | | | | | | | | |
| GameSet | 1 | | | | | | | | | | | | | | | |
| CiPherTextA | W | F | B | I | M | D | V | I | K | Y | E | S | 0 | S | N | L |
| Puzzle | | | | | | | | | | | | | | | | |
| GameSet | 2 | | | | | | | | | | | | | | | |
| CipherTextA | L | S | O | U | B | M | A | R | H | W | F | P | C | Y | X | A |
| Puzzle | 4 | | | | | | | | | | | | | | | |
| GameSet | 2 | | | | | | | | | | | | | | | |
| CipherTextA | U | S | H | O | V | I | F | Y | B | L | F | E | Y | N | P | V |
| CipherTextB | 3 | D | B | V | R | T | U | X | H | L | B | U | P | A | W | Q |
| CipherTextC | E | X | W | Z | H | T | Y | K | L | C | D | S | Q | G | V | I |

The numerical value subroutine 255 (FIG. 28) is the last subroutine run to create Form #2. Following this subroutine, the microprocessor displays the letters of the alphabet at the bottom of Form #2 (see FIG. together with their numerical values, A=1 and 27, B=2 and 28, . . . , Z=26 and 52. The subroutine creates a file, NumericValue., in RAM by loading the NumericValue ROM file. See Table V. The microprocessor then displays that file on Form #2 (step 256). Finally, for each letter of the CipherText, the microprocessor finds the lower numerical value in the NumericValue file in RAM, enters that value in the Cipher. area of RAM and displays the value on the Numerical Value line of the cryptographic work area 208 (step 257). Form #2 is now completed.

TABLE V

| Letter | Numeric Values Value1 | Value2 |
|---|---|---|
| A | 1 | 27 |
| B | 2 | 28 |
| C | 3 | 29 |
| D | 4 | 30 |
| E | 5 | 31 |
| F | 6 | 32 |
| G | 7 | 33 |
| H | 8 | 34 |
| I | 9 | 35 |
| J | 10 | 36 |
| K | 11 | 37 |
| L | 12 | 38 |
| M | 13 | 39 |
| N | 14 | 40 |
| O | 15 | 41 |
| P | 16 | 42 |

TABLE V-continued

| Letter | Numeric Values Value1 | Value2 |
|---|---|---|
| Q | 17 | 43 |
| R | 18 | 44 |
| S | 19 | 45 |
| T | 20 | 46 |

TABLE V-continued

| Letter | Numeric Values Value1 | Value2 |
|---|---|---|
| U | 21 | 47 |
| V | 22 | 48 |
| W | 23 | 49 |
| X | 24 | 50 |
| Y | 25 | 51 |
| Z | 26 | 52 |

Figure 29:
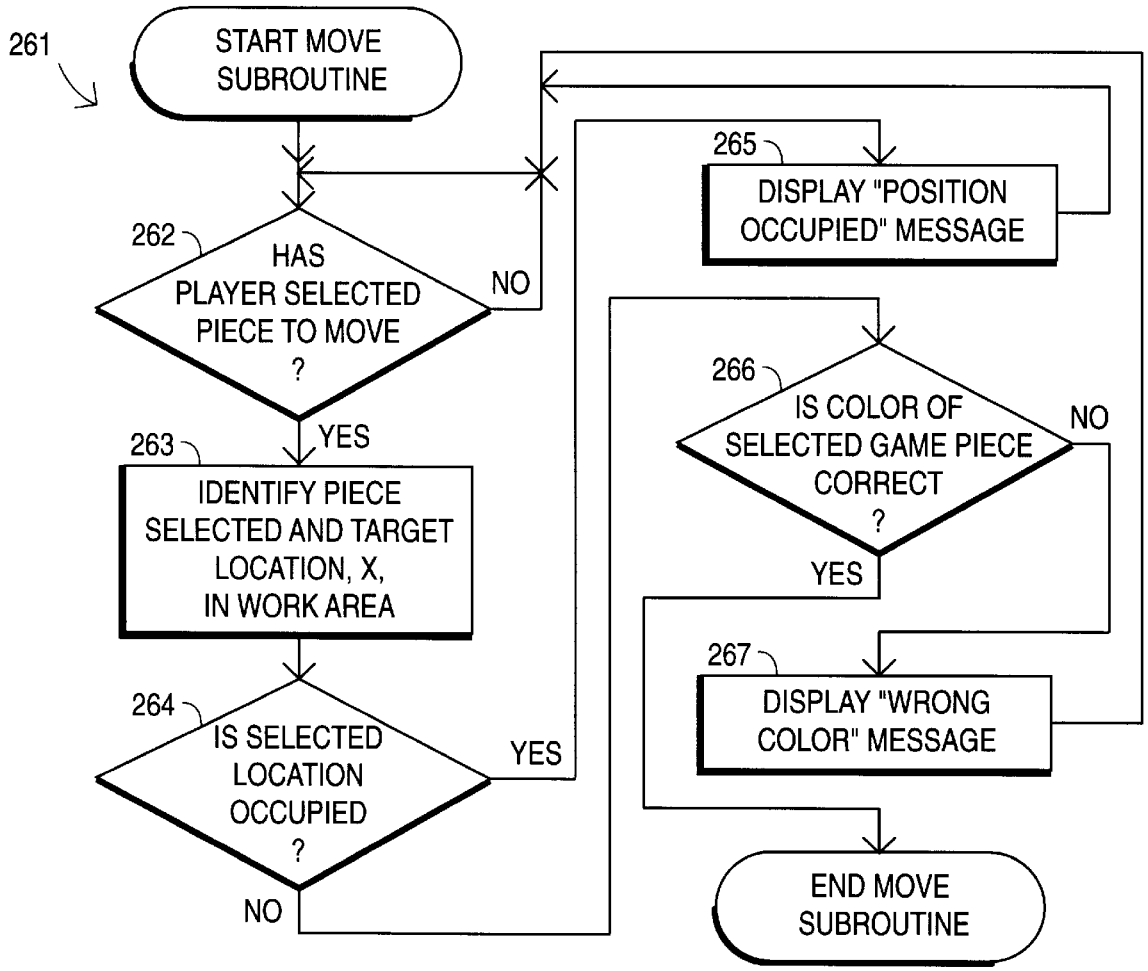
FIG. 29 is a flow chart diagram of a puzzle-piece move subroutine shown in FIG. 23.

To solve the puzzle, the player now moves game pieces from the game set area 204 of Form #2 to the work area 206 (FIG. 22). The microprocessor monitors and responds to this process in a move subroutine 261 shown in FIGS. 23 and 29. The player moves a game piece by clicking the mouse on the desired piece in the game set area 204 and dragging the mouse to the desired location, X, in the work area 206.

Upon detecting at an inquiry 262 (FIG. 29) that the player has moved a piece, the microprocessor first determines, in a step 263, the identity of the game piece and the target location in work area 206 selected by the user. The microprocessor then checks, in a step 264, the WorkArea. file in RAM to see if position X in the work area 206 is already occupied. If it is, the microprocessor displays on Form #2 the message "Position Occupied" and the move is aborted (step 265). If position X in work area 206 is not occupied, move subroutine 261 then leads the microprocessor in a step 266 to check if the color of the game piece matches the color of that position of the player-selected geometrical puzzle design, Puzzle.NumN. If the color does not match, the microprocessor displays on Form #2 the message "Wrong Color" and the move is aborted in a step 267. If the color does match, the microprocessor proceeds to complete the move.

Figure 30:
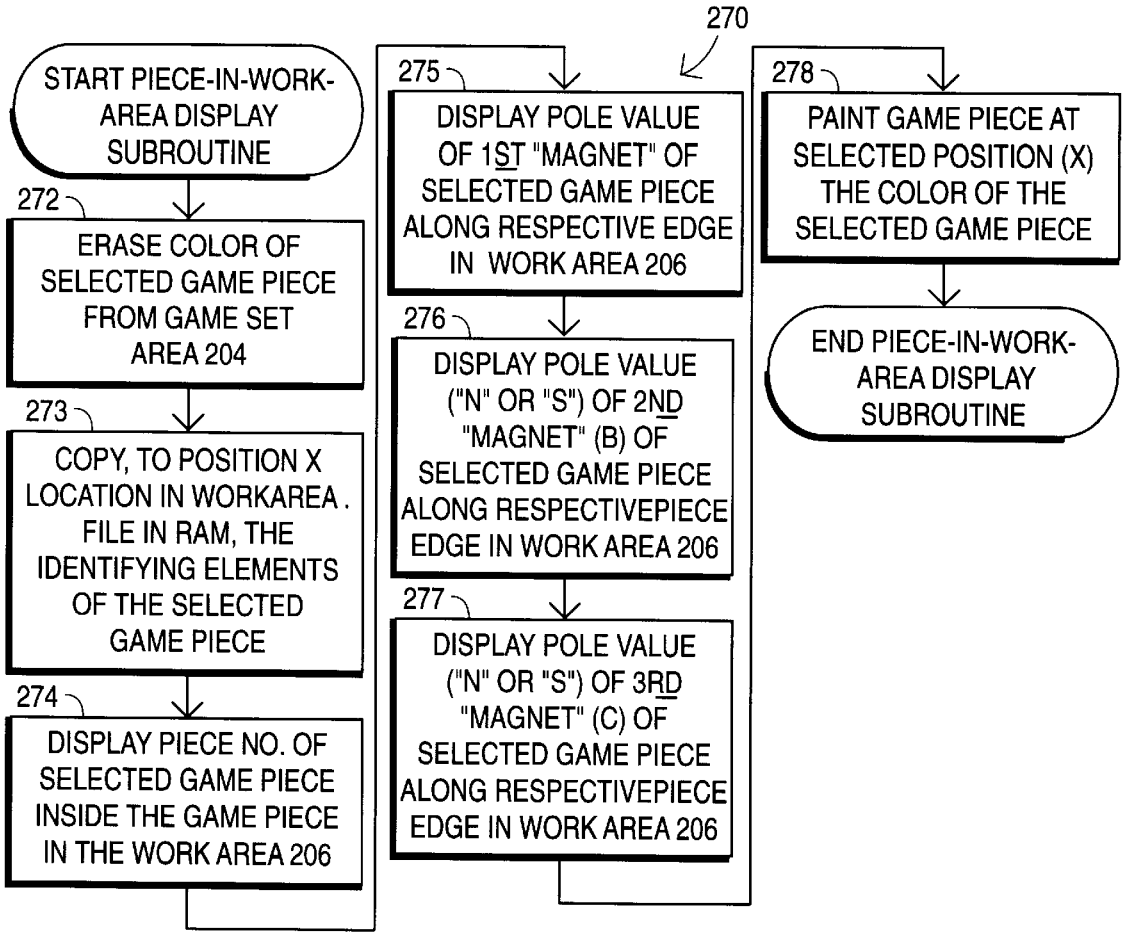
FIG. 30 is a flow chart diagram of a piece-in-work-area display subroutine shown in FIG. 23.

The microprocessor first paints the selected piece in game set area 204 the background color in a step 326 (FIG. 23), thereby indicating that the piece has been used and is no longer available. The microprocessor then runs a piece-in-work-area display subroutine 270 depicted in FIG. 23 and in detail in FIG. 30. In an initial step 272 of this subroutine, the microprocessor erases the color of the game set piece moved from the game set display area 204 (FIG. 22) to the work area 206. In a following step 273, the microprocessor copies to position X (Pos X) of the work area 206 and, more specifically, to corresponding locations in the WorkArea. file in RAM, the PiecNum, Color, MagnetA, MagnetB, MagnetC, and PiecType values for that piece from the GameSet. file. In subsequent steps 274–277, the microprocessor displays the piece number (PiecNum), the color, the magnetic pole of a first magnet (MagnetA), the magnetic pole of a second magnet (MagnetB), and the magnetic pole of a third magnet (MagnetC) in the piece in the work area 206 by obtaining mid-point coordinates MidX, MidY for position X (Pos X) from the Shape. file in RAM and adjusting those coordinates for the various magnets and pieces so that the piece numbers and pole designations are located inside the respective game pieces in the work area 206. Finally, the microprocessor paints the piece in work area 206 its predefined color in a step 278.

Figure 31:
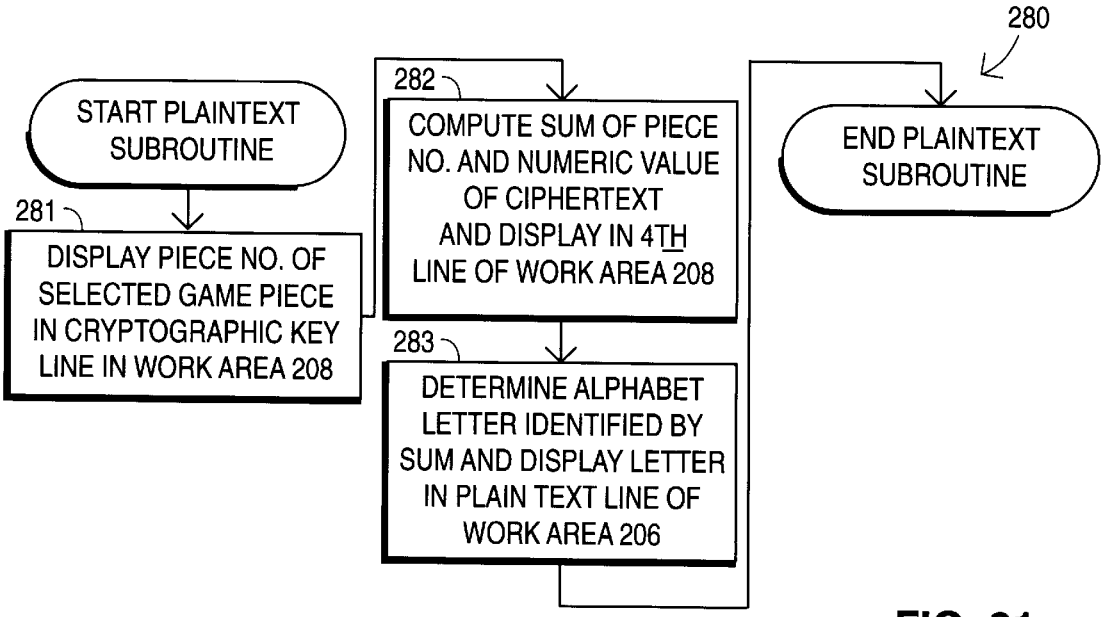
FIG. 31 is a flow chart diagram of a plaintext subroutine shown in FIG. 23.

Once the piece is displayed at position X (Pos X) of work area 206, the microprocessor then runs a plaintext subroutine 280, depicted in FIG. 23 and in detail in FIG. 31. Where the cryptographic key is generated by simply reading the piece number from the piece, as identified by the ciphertext chosen by the player for the selected geometrical puzzle design, Puzzle N, and the selected set of game pieces, Game Set M, the plaintext subroutine causes the microprocessor in a step 281 to simply enter the piece number in an area CryptoKey, Pos X, of the Cipher. RAM file, add that value to the numerical value of CipherText, Pos X, and then, using the NumericValue. file, find the letter of the alphabet corresponding with the numeric value of the sum. In a subsequent step 282, the microprocessor displays the value CryptoKey, Pos X, on the cryptographic key line of the ciphertext display area 208, and the alphanumeric character Plaintext, Pos X, on the plaintext line of that sisplay area. If a different method of generating a cryptographic key from the sequence of the game pieces is used, such as counting the number of pieces between identical piece types, that system is identified when the player selects a ciphertext or encryption for the selected geometrical puzzle design, Puzzle N, and the selected set of game pieces, Game Set M. In further operations according to plaintext subroutine 280, the microprocessor follows a different path to display the plaintext, sometimes requiring many pieces to be moved to the work area 206 before additional plaintext can be computed and displayed (step 283).

Figure 32:
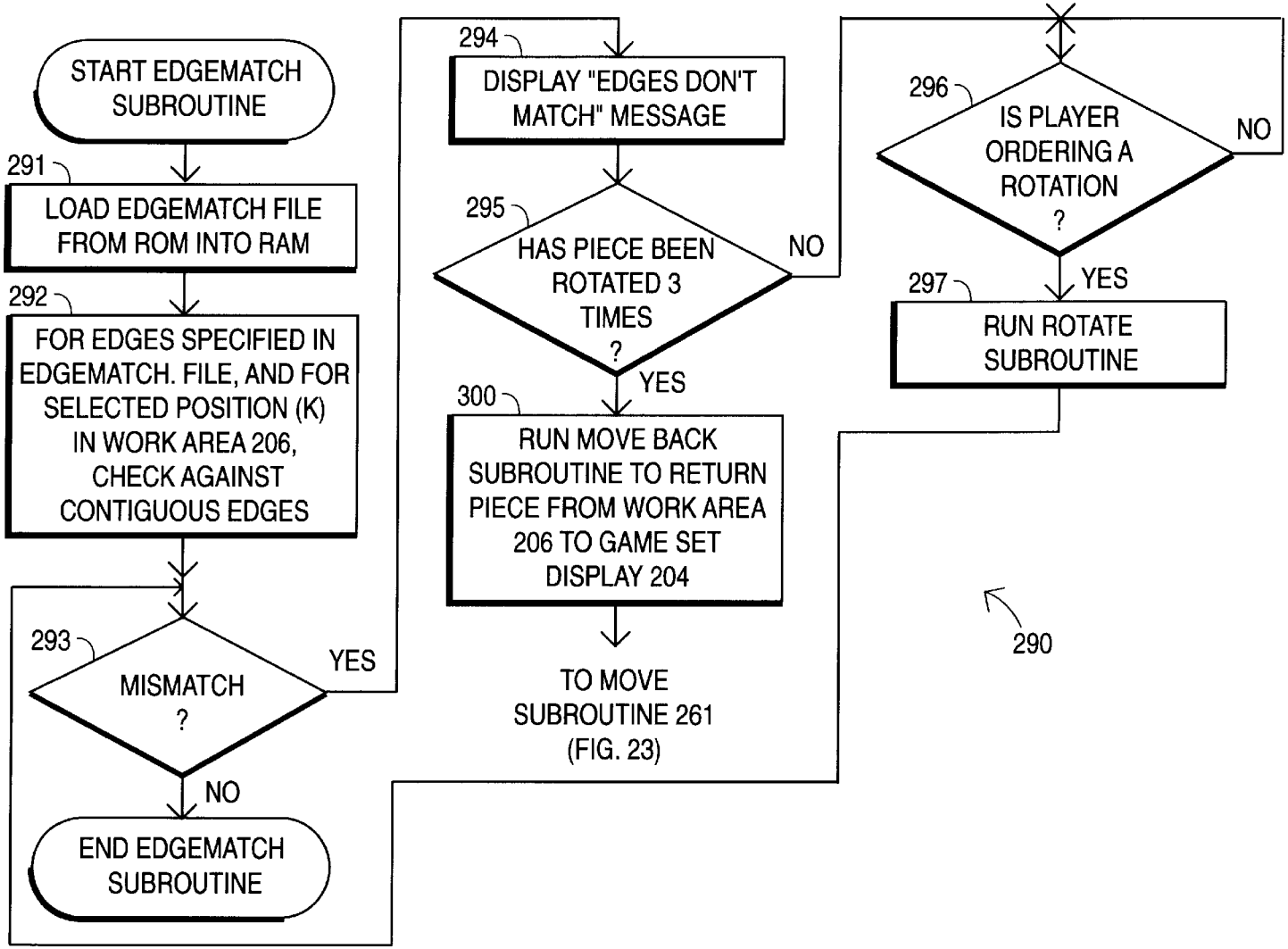
FIG. 32 is a flow chart diagram of an edge match subroutine shown in FIG. 23.
Figure 33:
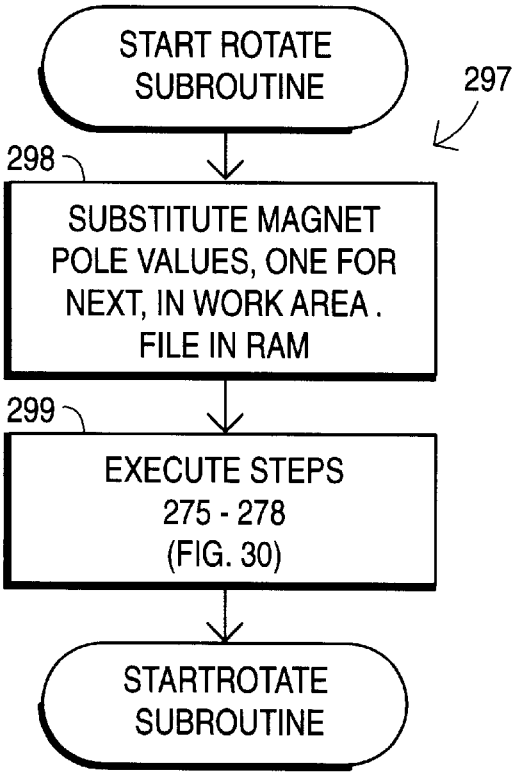
FIG. 33 is a flow chart diagram of a game-piece rotate subroutine shown in FIG. 23.

To check if the edges of the piece match, the microprocessor executes an edgematch subroutine 290, shown in FIG. 23 and in detail in FIG. 32. The microprocessor first reads the shape of the piece, in this case a triangle, from the Shape. file in RAM. Accordingly, in a step 291, the microprocessor loads a file, Edgematch.Triang, from ROM and creates a file in RAM with that name. See Table VII. In another step 292, the microprocessor then performs each edgematch check specified for position X (Pos X) in the Edgematch.Triang file to determine if adjacent pieces already displayed in work area 206 (FIG. 22) have contiguous edges match which do not match. If the piece moved to position X results in nonmatching edges, as determined by the microprocessor in an inquiry 293, the microprocessor displays the message "Edges Don't Match" on Form #2 in a step 294 and checks at a decision junction 295 whether the piece has already been rotated three times (for a triangle). If so, the microprocessor executes a move back subroutine 300 to return the piece from work area 206 to game set display area 204. If not, the microprocessor checks at 296 for a rotation request from the user. If the microprocessor detects a rotation request, it runs a rotate subroutine 297 shown in FIG. 33. This subroutine allows the player to rotate a piece at position X in the work area 206, by double clicking on the piece. In a step 298, the microprocessor then substitutes, in the WorkArea. file in RAM, the MagnetC value for the MagnetB value, the MagnetB value for the MagnetA value, and the MagnetA value for the MagnetC value and displays the results of the rotation at position N (Pos N) of the work area 206 by executing at 299 a series of steps 275–278 discussed above with reference to FIG. 30. The rotation subroutine 297 then returns the microprocessor to the edgematch subroutine 291, whereupon the microprocessor checks whether the rotation has eliminated the edgematch problem. If it has not, the player can continue rotating the piece in Position X or rotate one or more pieces in other positions.

TABLE VII

EdgeMatch. Triang

| EdgeMatch Pos@ | Triang Edges | Check1 | With1 | Check2 | With2 | Check3 | With3 |
|---|---|---|---|---|---|---|---|
| PosA | 1 | PosA.MagnetA | PosB.MagnetA | | | | |
| PosB | 3 | PosB.MagnetA | PosA.MagnetB | PosB.MagnetB | PosH.MagnetC | PosB.MagnetC | PosC.MagnetA |
| PosC | 2 | PosC.MagnetA | PosB.MagnetC | PosC.MagnetB | PosD.MagnetA | | |
| PosD | 3 | PosD.MagnetA | PosC.MagnetB | PosD.MagnetB | PosJ.MagnetC | PosD.MagnetC | PosE.MagnetA |
| PosE | 2 | PosE.MagnetA | PosD.MagnetC | PosE.MagnetB | PosF.MagnetA | | |
| PosF | 3 | PosF.MagnetA | PosE.MagnetB | PosP.MagnetB | PosL.MagnetC | PosP.MagnetC | PosG.MagnetA |
| PosG | 1 | PosG.MAgnetA | PosF.MagnetC | | | | |
| PosH | 2 | PosH.MagnetB | PosI.MagnetA | PosH MagnetC | PosB.MagnetB | | |

TABLE VII-continued

| EdgeMatch Pos@ | Triang Edges | Check1 | With1 | Check2 | With2 | Check3 | With3 |
|---|---|---|---|---|---|---|---|
| | | | EdgeMatch. Triang | | | | |
| PosI | 3 | Post.MagnetA | PosH.MagnetB | PosI MagnetB | PosM.MagnetC | PosI.MagnetC | PosJ.MagnetA |
| PosJ | 3 | Pos3.MagnetA | PosI.MagnetC | Pos3 MagnetB | PosK.MagnetA | PosJ.MagnetC | PosD.MagnetB |
| PosK | 3 | PosK.MagnetA | PosJ.MagnetB | Posk MagnctB | PosO.MagnetC | PosK.MagnetC | PosL.MagnetA |
| PosL | 2 | PosL.MagnetA | PosK.MagnetC | PosL MagnetC | PosF.MagnetB | | |
| PosM | 2 | PosM.MagnetB | PosN.MagnetA | PosM MagnetC | PosI.MagnetB | | |
| PosN | 3 | PosN.MAgnetA | PosM.MagnetB | PosN MagnetB | PosP.MagnetC | PosN.MagnetC | PosO.MagnetA |
| PosO | 2 | PosO.MagnetA | PosN.MagnetC | PosO MagnetC | PosK.MagnetB | | |
| PosP | 1 | PosP.MagnetC | PosN.MagnetB | | | | |

Figure 34:
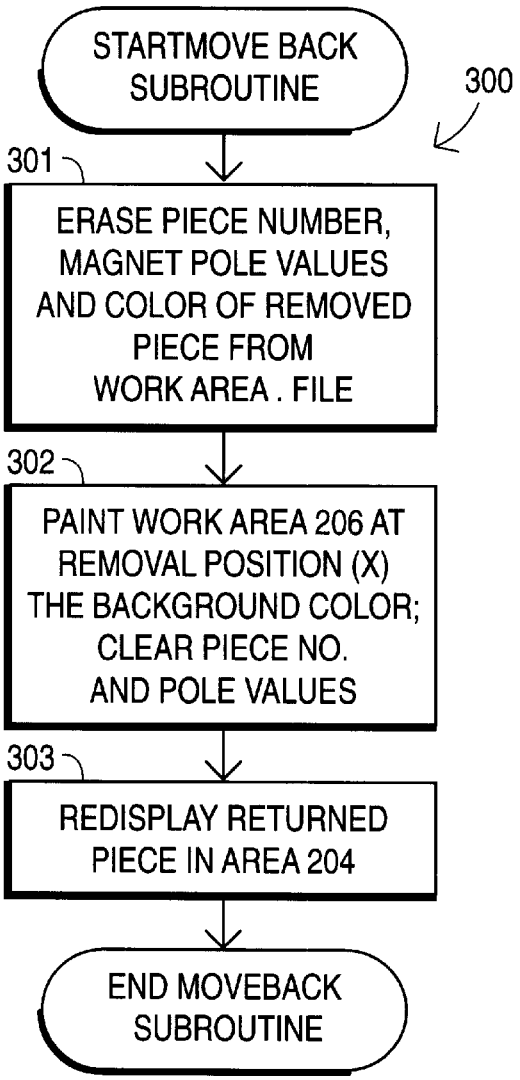
FIG. 34 is a flow chart diagram of a game-piece move-back subroutine shown in FIG. 23.

If the use of the rotation subroutine 297 does not solve the edgematch problem, or alternatively, the edges all match but the plaintext which is being generated does not make sense, the player will want to move one or more pieces back from the work area 206 to the game set area 204. The player does this by clicking the mouse on the piece to be moved back. The microprocessor will then run a move back subroutine 300 (FIG. 34), which clears all the values for Position N in the WorkArea. file (step 301), erases from that position in the work area 206 the color of the game piece, its piece number and magnet values (step 302), and redisplays the color for that game piece in the game set display 204 (step 303).

The player proceeds with moving pieces, rotating them and moving them back until the puzzle sequence is solved with no edge mismatches and until the plaintext makes sense.

Although the invention has been described in terms of particular embodiments and applications, one of ordinary skill in the art, in light of this teaching, can generate additional embodiments and modifications without departing from the spirit of or exceeding the scope of the claimed invention. It is to be noted, for example, that a cryptographic puzzle may be used in conjunction with other geometric type puzzles such as conventional jigsaw puzzles and newer games such as Triazzles™. In the case of jigsaw puzzles, the rule according to which the game pieces may be disposed adjacent to one another is embodied in the shapes of the tongues or projections and the shapes of the recesses. Thus, only where a tongue on one game piece is and a recess on another game piece are geometrically congruent, will the two pieces be capable of being placed adjacent to one another. Of course, the various jigsaw pieces may be provided with indicia, such as printed numerals, from which cryptographic keys may be derived for solving a cryptographic component of a combination jigsaw/cryptogram puzzle. The cryptographic puzzle component may be utilized instead of a picture to aid a player in deciding whether the game pieces have been arranged together in proper fashion to generate a solution to the combination puzzle.

It is to be noted that a series of alphanumeric characters may be derived from a particular geometric permutation of puzzle pieces by techniques other than the generation of integers. For instance, a code may be provided for determining an alphanumeric character of a cryptographic message from an associated letter in an encryption and indicia provided on the game pieces. An index or marking such as an asterisk may lead to a specified alphanumeric character (e.g. the letter "G") when the asterisk is combined with the letter "A" in an encryption.

Accordingly, it is to be understood that the drawings and descriptions herein are proffered by way of example to facilitate comprehension of the invention and should not be construed to limit the scope thereof.

What is claimed is:

1. A method for playing a game, comprising:

(i) providing:

(a) a plurality of game pieces each having a plurality of sides, said game pieces embodying at least one rule according to which said game pieces may be disposed adjacent to one another, said rule specifying that each side of each game piece may be placed adjacent to only selected sides of other game pieces; and (b) an encryption of a predetermined cryptographic message;

(ii) placing said game pieces adjacent to each other in one particular permutation to generate a predetermined geometrical design, said predetermined geometrical design being producible by any of a plurality of permutations of said game pieces;

(iii) generating a series of alphanumeric characters from said particular permutation and said encryption, said game pieces bearing indicia from which said series of alphanumeric characters is generated; and (iv) in the event that the series of generated alphanumeric characters fails to render a sensible message, removing at least one of the game pieces of said particular permutation and regenerating said predetermined geometrical design by placing said game pieces adjacent to each other in another particular permutation.

2. The method defined in claim 1 wherein each side of said game pieces has one of exactly two possible states, a side of said game pieces having a first one of said two possible states being permissibly adjacent only sides of said game pieces having a second one of said two possible states, the placing said game pieces adjacent to each other in said one particular permutation to generate said predetermined geometrical design including placing said game pieces so that sides of said game pieces having said first one of said two possible states are adjacent only sides of said game pieces having said second one of said two possible states.

3. The method defined in claim 2 wherein each side of said game pieces defines a surface and is provided with a magnet having a magnetic field with field lines oriented substantially perpendicularly to said surface, the placing said game pieces adjacent to each other in said one particular permutation to generate said predetermined geometrical design including placing said game pieces so that sides of said game pieces having a north magnetic field pole are adjacent only sides of said game pieces having a south magnetic field pole.

4. The method defined in claim 1 wherein said game pieces are each provided with an auxiliary marking, said predetermined geometrical design including a predetermined arrangement of the auxiliary markings of said game pieces, the placing of said game pieces adjacent to each other in said one particular permutation to generate said predetermined geometrical design including placing said game pieces so that the auxiliary markings of said game pieces are positioned in said predetermined arrangement.

5. The method defined in claim 4 wherein said game pieces are each provided with an auxiliary marking which is one of a plurality of possible markings, a plurality of said game pieces having a first one of said possible markings and another plurality of said game pieces having a second one of said possible markings.

6. The method defined in claim 5 wherein said possible markings are different colors.

7. The method defined in claim 1 wherein said game pieces are essentially planar pieces each having at least three sides, the placing of said game pieces adjacent to each other in said one particular permutation to generate said predetermined geometrical design including placing the sides of said game pieces in contiguity with one another.

8. The method defined in claim 1 wherein the generating of said series of alphanumeric characters includes generating a series of integers from said particular permutation and algebraically combining said integers with respective numbers of said encryption to derive successive alphanumeric characters.

9. The method defined in claim 8 wherein said indicia are numerals provided on said game pieces, the generating of said series of integers being implemented by the placement of said game pieces.

10. The method defined in claim 8 wherein said indicia include a first recognizable characteristic and a second recognizable characteristic, said game pieces include a first subset of game pieces all having said first recognizable characteristic and a second subset of game pieces all having said second recognizable characteristic distinguishable from said first recognizable characteristic, the generating of said series of integers including counting a number of said game pieces between successive occurrences of said first recognizable characteristic and a number of said game pieces between successive occurrences of said second recognizable characteristic.

11. The method defined in claim 1 wherein the step of providing includes providing an indication of an order in which game pieces placed in any given permutation to produce said predetermined geometrical design are to be considered in generating said series of alphanumeric characters.

12. A game kit comprising:

a plurality of game pieces each having a plurality of sides, said game pieces embodying at least one rule according to which said game pieces may be disposed adjacent to one another, said rule specifying that each side of each game piece may be placed adjacent to only selected sides of other game pieces; and encryptions of a plurality of predetermined cryptographic messages each associated with at least one predetermined geometrical design in which said game pieces may be placed so that each combination of one of said predetermined cryptographic messages and an associated predetermined geometric design represents a respective puzzle solvable in part by generating a series of alphanumeric characters from a selected permutation or arrangement of said game pieces and one of said encryptions, said game pieces bearing indicia from which said series of alphanumeric characters is generated, and determining whether the generated series of alphanumeric characters represents one of said cryptographic messages.

13. The kit defined in claim 12 wherein each side of said game pieces has one of exactly two possible states, a side of said game pieces having a first one of said two possible states being permissibly adjacent only sides of said game pieces having a second one of said two possible states.

14. The kit defined in claim 13 wherein each side of said game pieces defines a surface and is provided with a magnet having a magnetic field with field lines oriented substantially perpendicularly to aid surface.

15. The kit defined in claim 12 wherein said game pieces are each provided with an auxiliary marking, each said predetermined geometrical design including a predetermined arrangement of the auxiliary markings of said game pieces.

16. The kit defined in claim 15 wherein said game pieces are each provided with an auxiliary marking which is one of a plurality of possible markings, a plurality of said game pieces having a first one of said possible markings and another plurality of said game pieces having a second one of said possible markings.

17. The kit defined in claim 16 wherein said possible markings are different colors.

18. The kit defined in claim 12 wherein said game pieces are essentially planar pieces each having at least three sides.

19. The kit defined in claim 12 wherein said indicia are numerals provided on said game pieces.

20. The kit defined in claim 12 wherein said indicia enable the generation of a series of integers from the selected permutation or arrangement of said game pieces, so that said integers when algebraically combined with respective numbers of said one of said encryptions define successive alphanumeric characters.

21. The kit defined in claim 20, further comprising an indication of an order in which game pieces placed in any given permutation to produce said predetermined geometrical design are to be considered in generating said series of integers.

22. The kit defined in claim 12 wherein said indicia include a first recognizable characteristic and a second recognizable characteristic, said game pieces include a first subset of game pieces all having said first recognizable characteristic and a second subset of game pieces all having said second recognizable characteristic distinguishable from said first recognizable characteristic, said series of integers being generated by counting a number of said game pieces between successive occurrences of said first recognizable characteristic and a number of said game pieces between successive occurrences of said second recognizable characteristic.

23. The kit defined in claim 12, further comprising a plurality of pictorial representations showing respective predetermined geometrical designs in which said game pieces may be placed, each of said predetermined geometrical designs being producible by any of a plurality of permutations of said game pieces.

24. A method for playing a game, comprising:

(i) providing a plurality of game pieces each having a plurality of sides, said game pieces embodying at least one rule according to which said game pieces may be disposed adjacent to one another, said rule specifying that each side of each game piece may be placed adjacent to only selected sides of other game pieces, at least some of said game pieces being each provided with an auxiliary marking which is one of a plurality of possible auxiliary markings, a plurality of said game pieces having a first one of said possible auxiliary markings and another plurality of said game pieces having a second one of said possible auxiliary markings;

(ii) providing a plurality of graphic representations of predetermined geometrical designs indicating respective predetermined composite configurations of said game pieces and respective predetermined arrangements of the auxiliary markings provided on said game pieces, plural game pieces having said first one of said possible auxiliary markings being spaced or separated from one another in at least one of said arrangements; and (iii) placing said game pieces adjacent to each other to generate a selected one of said predetermined geometrical designs.

25. The method defined in claim 24 wherein said game pieces are placed adjacent to each other in one particular permutation to generate said selected one of said predetermined geometrical designs, said selected one of said predetermined geometrical designs being producible by any of a plurality of permutations of said game pieces.

26. The method defined in claim 25, further comprising:

(iv) providing an ancillary puzzle keyed to said selected one of said predetermined geometrical designs;

(v) determining clues from said game pieces after placement of said game pieces in said particular permutation; and (vi) solving said ancillary puzzle from said clues to thereby ascertain whether said particular permutation is a solution to said selected one of said predetermined geometrical designs.

27. The method defined in claim 26 wherein said ancillary puzzle includes an encryption of a predetermined cryptographic message and said clues are integers, the determining of said clues including generating said integers from said particular permutation, said game pieces bearing indicia from which said integers are generated, the solving of said ancillary puzzle including algebraically combining said integers with respective numbers of an encryption to derive successive alphanumeric characters.

28. The method defined in claim 24 wherein said possible markings are different colors.

29. The method defined in claim 25 wherein each side of said game pieces has one of exactly two possible states, a side of said game pieces having a first one of said two possible states being permissibly adjacent only sides of said game pieces having a second one of said two possible states, the placing said game pieces adjacent to each other in said one particular permutation to generate said selected one of said predetermined geometrical designs including placing said game pieces so that sides of said game pieces having said first one of said two possible states are adjacent only sides of said game pieces having said second one of said two possible states.

30. The method defined in claim 29 wherein each side of said game pieces defines a surface and is provided with a magnet having a magnetic field with field lines oriented substantially perpendicularly to said surface, the placing said game pieces adjacent to each other in said one particular permutation to generate said selected one of said predetermined geometrical designs including placing said game pieces so that sides of said game pieces having a north magnetic field pole are adjacent only sides of said game pieces having a south magnetic field pole.

31. The method defined in claim 30 wherein said game pieces are essentially planar pieces each having at least three sides, the placing of said game pieces adjacent to each other in said one particular permutation to generate said selected one of said predetermined geometrical designs including placing the sides of said game pieces in contiguity with one another.

32. A method for playing a game, comprising:

(i) providing a plurality of game pieces each having a plurality of sides and each bearing indicia from which a series of alphanumeric characters may be generated upon placement of said game pieces in an order;

(ii) also providing an encryption of a predetermined cryptographic message;

(iii) placing said game pieces adjacent to each other in one particular permutation;

(iv) generating said series of alphanumeric characters from said particular permutation and said encryption; and (v) in the event that the generated series of alphanumeric characters fails to render a sensible message, removing at least one of the game pieces of said particular permutation and placing said game pieces adjacent to each other in another particular permutation.

33. The method defined in claim 32 wherein said game pieces embody at least one rule according to which said game pieces may be disposed adjacent to one another, said rule specifying that each side of each game piece may be placed adjacent to only selected sides of other game pieces, the placing of said game pieces being undertaken in accordance with said rule.

34. The method defined in claim 32, further comprising providing a pictorial representation of a predetermined geometrical design, said one particular permutation and said another particular permutation reproducing said predetermined geometrical design.

35. The method defined in claim 32 wherein the generating of said series of alphanumeric characters includes generating a series of integers from said particular permutation and algebraically combining said integers with respective numbers of said encryption to derive successive alphanumeric characters.

36. The method defined in claim 35 wherein said indicia are numerals provided on said game pieces, the generating of said series of integers being implemented by the placement of said game pieces.

37. The method defined in claim 32, further comprising providing an indication of an order in which game pieces placed in any given permutation to produce said predetermined geometrical design are to be considered in generating said series of integers.

38. The method defined in claim 32 wherein said indicia include a first recognizable characteristic and a second recognizable characteristic, said game pieces include a first subset of game pieces all having said first recognizable characteristic and a second subset of game pieces all having said second recognizable characteristic distinguishable from said first recognizable characteristic, the generating of said series of integers including counting a number of said game pieces between successive occurrences of said first recognizable characteristic and a number of said game pieces between successive occurrences of said second recognizable characteristic.

39. A game kit comprising:

a plurality of game pieces each having a plurality of sides, said game pieces each bearing indicia from which a series of alphanumeric characters may be generated upon placement of said game pieces in a permutation or arrangement; and an encryption of predetermined cryptographic message representing a puzzle solvable in part by (a) generating said series of alphanumeric characters from a selected permutation or arrangement of said game pieces and (c) determining whether the generated series of alphanumeric characters represents an comprehendible message.

40. The kit defined in claim 39, further comprising an indication of an order in which game pieces placed in any given permutation or arrangement are to be considered in generating said series of alphanumeric characters.

41. The kit defined in claim 39 wherein said game pieces embody at least one rule according to which said game pieces may be disposed adjacent to one another, said rule specifying that each side of each game piece may be placed adjacent to only selected sides of other game pieces.

42. The kit defined in claim 41 wherein each side of said game pieces has one of exactly two possible states, a side of said game pieces having a first one of said two possible states being permissibly adjacent only sides of said game pieces having a second one of said two possible states.

43. The kit defined in claim 39, further comprising a plurality of pictorial representations showing respective predetermined geometrical designs in which said game pieces may be placed, each of said predetermined geometrical designs being producible by any of a plurality of permutations of said game pieces, each of said predetermined geometrical designs being associated with an encryption of a respective predetermined cryptographic message.

44. A game kit comprising:

a plurality of game pieces each having a plurality of sides, said game pieces embodying at least one rule according to which said game pieces may be disposed adjacent to one another, said rule specifying that each side of each game piece may be placed adjacent to only selected sides of other game pieces, at least some of said game pieces being each provided with an auxiliary marking which is one of a plurality of possible auxiliary markings, a plurality of said game pieces having a first one of said possible auxiliary markings and another plurality of said game pieces having a second one of said possible auxiliary markings; and a plurality of graphic representations of predetermined geometrical designs indicating respective predetermined composite configurations of said game pieces and respective predetermined arrangements of the auxiliary markings provided on said game pieces, plural game pieces having said first one of said possible auxiliary markings being spaced or separated from one another in at least one of said arrangements.

45. The game kit defined in claim 44 wherein said predetermined geometrical designs are each producible by any of a plurality of permutations of said game pieces.

46. The game kit defined in claim 45, further comprising:

an ancillary puzzle keyed to one of said predetermined geometrical designs; and means on said games pieces for enabling a determination of clues to solving said ancillary puzzle after placement of said game pieces in a particular predetermined permutation.

47. The game kit defined in claim 46 wherein said ancillary puzzle includes an encryption of a predetermined cryptographic message and said clues are integers, said game pieces bearing indicia from which said integers are generated, whereby said ancillary puzzle is solved by algebraically combining said integers with respective numbers of an encryption to derive successive alphanumeric characters.

48. The game kit defined in claim 47, further comprising an indication of an order in which game pieces placed in any given permutation to produce said one of said predetermined geometrical designs are to be considered in generating said integers.

49. The game kit defined in claim 47 wherein said indicia include a first recognizable characteristic and a second recognizable characteristic, said game pieces include a first subset of game pieces all having said first recognizable characteristic and a second subset of game pieces all having said second recognizable characteristic distinguishable from said first recognizable characteristic, whereby the series of integers is generated by counting a number of said game pieces between successive occurrences of said first recognizable characteristic and a number of said game pieces between successive occurrences of said second recognizable characteristic.

50. The game kit defined in claim 44 wherein said possible markings are different colors.

51. The game kit defined in claim 44 wherein each side of said game pieces has one of exactly two possible states, a side of said game pieces having a first one of said two possible states being permissibly adjacent only sides of said game pieces having a second one of said two possible states.

52. The game kit defined in claim 51 wherein each side of said game pieces defines a surface and is provided with a magnet having a magnetic field with field lines oriented substantially perpendicularly to said surface.

53. The game kit defined in claim 52 wherein said game pieces are essentially planar pieces each having at least three sides or edges.

54. A game kit comprising:

a plurality of game pieces each having a plurality of sides, said game pieces embodying at least one rule according to which said game pieces may be disposed adjacent to one another, said rule specifying that each side of each game piece may be placed adjacent to only selected sides of other game pieces;

a graphic representation of a predetermined geometrical design indicating a predetermined composite configuration of said game pieces;

an ancillary puzzle keyed to said predetermined geometrical design; and means on said games pieces for enabling a determination of clues to solving said ancillary puzzle after placement of said game pieces in said particular permutation.

* * * * *